US009801513B2

(12) United States Patent
Conrad et al.

(10) Patent No.: US 9,801,513 B2
(45) Date of Patent: Oct. 31, 2017

(54) TURBO BRUSH

(71) Applicant: Omachron Intellectual Property Inc., Hampton (CA)

(72) Inventors: Wayne Ernest Conrad, Hampton (CA); Leonid Katsman, Vaughan (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 650 days.

(21) Appl. No.: 13/684,069

(22) Filed: Nov. 21, 2012

(65) Prior Publication Data

US 2013/0139350 A1 Jun. 6, 2013

Related U.S. Application Data

(60) Provisional application No. 61/563,581, filed on Nov. 24, 2011.

(51) Int. Cl.
*A47L 9/04* (2006.01)

(52) U.S. Cl.
CPC ..... *A47L 9/0416* (2013.01); *A47L 9/0433* (2013.01)

(58) Field of Classification Search
CPC ..... A47L 9/0416; A47L 9/0427; A47L 9/045; A47L 9/033; A47L 5/22
USPC ..... 15/387
See application file for complete search history.

(56) References Cited

U.S. PATENT DOCUMENTS 1,475,079 A 11/1923 Miller
1,727,524 A * 9/1929 Spencer ..... A47L 9/0416 15/349
2,930,069 A * 3/1960 Kowalewski ..... A47L 9/0416 15/375
6,916,351 B2 7/2005 Oh
7,062,816 B2 * 6/2006 Kasper et al. ..... 15/340.2
7,146,682 B2 12/2006 Damman et al.
7,334,291 B2 2/2008 Song et al.
7,392,566 B2 7/2008 Gordon et al.
7,412,750 B2 8/2008 Oh
7,673,370 B2 3/2010 Frederick et al.
2001/0054214 A1 * 12/2001 Kalman ..... A47L 9/0416 15/387
2005/0223522 A1 * 10/2005 Song ..... A47L 9/0416 15/387
2010/0107356 A1 5/2010 Jakubos et al.
2011/0099751 A1 * 5/2011 Conrad ..... A47L 7/02 15/387

FOREIGN PATENT DOCUMENTS

GB 367467 A 2/1932

* cited by examiner

*Primary Examiner* — Monica Carter
*Assistant Examiner* — Stephanie Berry
(74) *Attorney, Agent, or Firm* — Philip C. Mendes da Costa; Bereskin & Parr LLP/S.E.N.C.R.L., s.r.l.

(57) ABSTRACT

A turbo brush for cleaning a surface comprises a housing having an upper surface, a lower surface, a front end and a rear end, the lower end having a dirty air inlet. A primary air flow path extends from the dirty air inlet to a dirty air outlet. A rotary brush is associated with the dirty air inlet and extends transverse to a forward direction of movement of the turbo brush. A drive mechanism comprises an air driven turbine, a drive gear drivingly connected to the rotary brush and a worm gear directly drivingly connecting the air driven turbine and the drive gear.

19 Claims, 16 Drawing Sheets

TURBO BRUSH

This application claims priority from U.S. provisional application No. 61/563,581 which was filed on Nov. 24, 2011.

FIELD

This invention relates to a turbo brush, which may be utilized with the surface cleaning apparatus such as a vacuum cleaner. In a particular embodiment, the turbo brush utilizes a worm drive driven by a clean air turbine.

INTRODUCTION

Various types of turbo brush designs for vacuum cleaners and the like are known. An advantage of a turbo brush is that an electrical drive motor is not required in the turbo brush housing and, accordingly, the turbo brush need not be electrically connected to, e.g. the AC input, or the suction motor housing. Instead, a rotary brush or the like is driven by an air turbine.

A turbo brush may utilize a clean air driven turbine or a dirty air driven turbine. In a dirty air driven turbine system the turbine is positioned in the dirty air flow stream that extends from the dirty air inlet of the turbo brush to a position downstream of the turbine (e.g. the air flow conduit extending to an air treatment member or members of the surface cleaning apparatus). An advantage of this design is that all of the air flow generated by a suction motor upstream of the turbo brush is drawn through the dirty air inlet thereby maximizing the airflow that passes through the air driven turbine thereby increasing the motive force which may be applied to the rotary brush. A downside of such designs is that the vanes and bearing of the air driven turbine may become clogged with dirt, hair or the like.

An advantage of the clean air driven turbo brush is that the dirt entrained in the air stream entering the turbo brush dirty air inlet will not travel through the turbine. Accordingly, the air turbine will not become clogged with dirt picked up by the turbo brush. However, a disadvantage of this design is that a portion of the airflow generated by the suction motor does not pass through the dirty air inlet of the turbo brush. All other design parameters remaining the same, this reduces the velocity of the airflow at the dirty air inlet and thereby reduces the cleaning effectiveness of the turbo brush. The more air which is drawn through the clean air turbine to power the rotary brush, the less air is drawn through the dirty air inlet thereby reducing the cleaning effectiveness of the turbo brush.

SUMMARY

In accordance with this disclosure, several improvements in the design of a turbo brush for a surface cleaning apparatus are provided. Each of these improvements may be used individually or with one or more of the other improvements.

In accordance with the first aspect of this disclosure, the drive mechanism for the rotary brush of a turbo brush comprises an air driven turbine, a worm gear drivingly connected to a rotary brush and the worm that directly, drivingly connects the air driven turbine and the worm gear. Accordingly, the worm may have a first end drivenly connected to the turbine and a second end drivingly engaging the worm gear with no intermediate linkage. As the worm is a direct connection between the turbine and the worm gear frictional losses and other mechanical inefficiencies inherent in more complicated mechanical linkages are avoided. For example, the worm may be rotatably support by only two bearings, e.g., one towards each end. Therefore, the mechanical losses would be those caused by the turbine, the transmission of motive force from the turbine to the worm, the transmission of motive force from the worm to the worm gear and the bearings. Accordingly, the amount of power that may be directed to the rotary brush is increased. An advantage of this design is that if all other features remain the same, a reduced amount of airflow may be utilized to produce the same amount of drive force for the rotary brush. Therefore, this design may be utilized to increase the cleaning effectiveness of the turbo brush.

In accordance with this design, there is provided a turbo brush for cleaning a surface comprising:

(a) a housing having an upper surface, a lower surface, a front end and a rear end, the lower end having a dirty air inlet;

(b) a primary air flow path extending from the dirty air inlet to a dirty air outlet;

(c) a rotary brush associated with the dirty air inlet and extending transverse to a forward direction of movement of the turbo brush; and, (d) a drive mechanism comprising an air driven turbine, a drive gear drivingly connected to the rotary brush and a worm gear directly drivingly connecting the air driven turbine and the drive gear.

In some embodiments, the rotary brush is positioned proximate the front end.

In some embodiments, the drive gear has an axis parallel to an axis of rotation of the rotary brush, and in some embodiments the drive gear is mounted co-axial with the rotary brush.

In some embodiments, the rotary brush comprises first and second portions and the drive gear is positioned between the first and second portions.

In some embodiments, the rotary brush is provided with a plurality of bristles, the worm gear has a drive end drivingly engaging the drive gear and the drive end is positioned radially inwardly of an outer radial extent of the bristles.

In some embodiments, the turbo brush further comprises an air filtering member adjacent the clean air inlet, and in some embodiments the air filtering member comprises a screen.

In some embodiments, the air driven turbine has turbine blades and an associated depressurization zone downstream thereof and the turbo brush further comprises a cowling downstream of the air driven turbine and positioned such that the depressurization zone is located downstream of the turbine blades, and in some embodiments the cowling is generally bullet nosed in shape.

In some embodiments, the turbo brush further comprises a secondary airflow path including the air driven turbine and extending from a clean air inlet to a position downstream from the air driven turbine, and in some embodiments the secondary airflow path joins the primary airflow path upstream of the dirty air outlet. In some embodiments, the primary air flow path has a primary cross sectional area and the air driven turbine has a flow path therethrough having a turbine flow path cross sectional area and the ratio of the primary cross sectional area to the turbine flow path cross sectional area is between 4:1-1:4. In some embodiments the ratio is between 4:1-1:1, or between 2:1-1:2.

In accordance with a second aspect of this disclosure, the bristles of the rotary brush of the turbo brush are configured so as to extend in overlying relation to the worm gear or other drive member provided on the rotary brush. For example, a worm gear may be co-axially mounted between the first and second opposed ends of a rotary brush, preferably at a mid-point between the opposed ends and more preferably centrally there between. By configuring the bristles to extend in overlying relation to the worm gear, the turbo brush may groom the portion of the carpet over which the worm gear passes. An advantage of this design is that when the turbo brush is drawn across a surface, all of the surface over which the turbo brush is drawn may be groomed. Therefore, repeated passes of the turbo brush over the same portion of a surface, e.g. carpet, is not required to provide a groomed appearance.

In accordance with this aspect, there is provided a turbo brush comprising:

(a) a housing having an upper surface, a lower surface, a front end and a rear end, the lower surface having a dirty air inlet;

(b) a primary air flow path extending from the dirty air inlet to a dirty air outlet;

(c) a rotary brush associated with the dirty air inlet and extending transverse to a forward direction of movement of the turbo brush, the rotary brush having a plurality of bristles; and, (d) a drive mechanism comprising an air driven turbine drivingly connected to the rotary brush and including a drive member located at the rotary brush, wherein the bristles extend at an angle so as to be positioned in overlying relation to the drive member.

In some embodiments, the drive mechanism comprises a worm gear, the drive member comprises a drive end of the worm gear that driving engages the rotary brush and the drive end is positioned radially inwardly of an outer radial extent of the bristles.

In some embodiments the air driven turbine is a clean air turbine.

In some embodiments the turbo brush further comprises a secondary airflow path including the air driven turbine and extending from a clean air inlet to a position downstream from the air driven turbine, and in some embodiments the secondary airflow path joins the primary airflow path upstream of the dirty air outlet. In some embodiments the secondary airflow path from the clean air inlet to a position downstream of the air driven turbine is generally linear. In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends. In some embodiments the rotary brush comprises first and second portions and the drive gear is positioned between the first and second portions. In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades. In some embodiments the turbo brush further comprises an airflow path downstream of the air driven turbine, the airflow path downstream of the air driven turbine having a cross sectional area greater than a cross sectional area of a flow path through the blades of the air driven turbine. In some embodiments the cowling is generally centrally located in the airflow path downstream of the air driven turbine and has a cross sectional area that decreases in a downstream direction. In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with a third aspect of this disclosure, an air driven turbine of a turbo brush is positioned in an air flow path that extends from a clean air inlet to a position downstream of the air driven turbine, e.g., the position at which the clean air stream merges with the dirty air stream extending from the dirty air inlet of the turbo brush. In this aspect, the secondary airflow path is generally linear. Accordingly, the air that travels through the turbo brush will travel in a generally linear manner. An advantage of this design is that the back pressure through the secondary air flow path is reduced. Including 90° bends and the like in the secondary airflow path increases the back pressure and, all parameters remaining the same, reduces the velocity of the air travelling through the air driven turbine thereby reducing the amount of power provided to the rotary brush. Alternately, if the turbo brush is designed so as to produce increased airflow through the air driven turbine to account for the back pressure losses, then the amount of air that is available to be drawn through the dirty air inlet is reduced thereby reducing the cleaning effectiveness of the turbo brush.

In accordance with this aspect of the disclosure, there is provided a turbo brush comprising:

(a) a housing having an upper surface, a lower surface, a front end and a rear end, the lower surface having a dirty air inlet;
(b) a primary air flow path extending from the dirty air inlet to a dirty air outlet;
(c) a rotary brush associated with the dirty air inlet and extending transverse to a forward direction of movement of the turbo brush;
(d) a drive mechanism comprising an air driven turbine drivingly connected to the rotary brush; and,
(e) a secondary airflow path including the air driven turbine and extending from a clean air inlet to a position downstream from the air driven turbine wherein the secondary airflow path is generally linear.

In some embodiments the drive mechanism comprises a worm gear, the drive member comprises a drive end of the worm gear that driving engages the rotary brush and the drive end is positioned radially inwardly of an outer radial extent of the bristles.

In some embodiments the air driven turbine is a clean air turbine.

In some embodiments the secondary airflow path joins the primary airflow path upstream of the dirty air outlet.

In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush. In some embodiments the rotary brush has transversely opposed first and second opposed ends and the drive gear is positioned between the opposed ends, and in some embodiments the drive gear is positioned at a midpoint between the opposed ends. In some embodiments the rotary brush comprises first and second portions and the drive gear is positioned between the first and second portions. In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades, and in some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction. In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with a fourth aspect of this disclosure, a cowling is provided downstream of the air driven turbine wherein the cowling is provided with a plurality of vanes extending in a direction of flow immediately downstream of the air driven turbine. As the air passes through the vanes of the air driven turbine, a rotary motion will be induced on the airflow. The vanes on the cowling are configured to reduce, and preferably eliminate, the rotary motion of the air downstream of the air driven turbine. This reduces potential turbulence in that airflow downstream of the air driven turbine. Providing a more linear airstream downstream of the turbine reduces pressure losses in the downstream airflow path thereby increasing the airflow that would pass through the turbine if no other changes are made to the airflow path.

In accordance with this aspect, there is provided a turbo brush for cleaning a surface comprising:

(a) a housing having an upper surface, a lower surface, a front end and a rear end, the lower end having a dirty air inlet;

(b) a primary air flow path extending from the dirty air inlet to a dirty air outlet;

(c) a rotary brush associated with the dirty air inlet and extending transverse to a forward direction of movement of the turbo brush;

a drive mechanism comprising an air driven turbine drivingly connected to the rotary brush; and, (d) a cowling downstream of the air driven turbine, the cowling including a plurality of vanes extending in a direction of flow immediately downstream of the air driven turbine.

In some embodiments the drive mechanism comprises a drive gear drivingly connected to the rotary brush and a worm gear directly drivingly connecting the air driven turbine and the drive gear.

In some embodiments the air driven turbine is a clean air turbine.

In some embodiments the turbo brush further comprises a secondary airflow path including the air driven turbine and extending from a clean air inlet to a position downstream from the air driven turbine. In some embodiments the secondary airflow path joins the primary airflow path upstream of the dirty air outlet, and in some embodiments the secondary airflow path from the clean air inlet to a position downstream of the air driven turbine is generally linear.

In some embodiments the rotary brush is positioned proximate the front end.

In some embodiments the drive gear has an axis parallel to an axis of rotation of the rotary brush, and in some embodiments the drive gear is mounted co-axial with the rotary brush. In some embodiments the rotary brush has transversely opposed first and second opposed ends and the drive gear is position between the opposed ends, and in some embodiments the drive gear is positioned at a midpoint between the opposed ends.

In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the cowling is positioned such that the depressurization zone is located downstream of the turbine blades.

In some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction. In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with a fifth aspect of this disclosure, an air filtering member such as a screen is provided in the secondary clean air flow path upstream of the air driven turbine. While the turbine may be driven by a clean air stream, during use, dirt, carpet fibers and the like may still enter the secondary clean airflow path and foul the air driven turbine. An advantage of providing a screen or the alike, such as at the air inlet to the secondary clean air flow path, is that particulate material or the alike which may foul the turbine may be filtered, thereby assisting in maintaining the performance of the turbine over a longer period of time.

In accordance with this aspect of the disclosure, there is provided a turbo brush for cleaning a surface comprising:

(a) a housing having an upper surface, a lower surface, a front end and a rear end, the lower end having a dirty air inlet;
(b) a primary air flow path extending from the dirty air inlet to a dirty air outlet;
(c) a rotary brush associated with the dirty air inlet and extending transverse to a forward direction of movement of the turbo brush;
(d) a drive mechanism comprising an air driven turbine drivingly connected to the rotary brush;
(e) a secondary air flow path including the air driven turbine and extending from a clean air inlet to a position downstream from the air driven turbine; and,
(f) an air filtering member in the secondary airflow path positioned upstream of the air driven turbine.

In some embodiments the drive mechanism comprises a drive gear drivingly connected to the rotary brush and a worm gear directly drivingly connecting the air driven turbine and the drive gear.

In some embodiments the air driven turbine is a clean air turbine.

In some embodiments the secondary airflow path joins the primary airflow path upstream of the dirty air outlet.

In some embodiments the secondary airflow path from the clean air inlet to a position downstream of the air driven turbine is generally linear.

In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends. In some embodiments, the rotary brush comprises first and second portions and the drive gear is positioned between the first and second portions, and in some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the air filtering member is positioned adjacent the clean air inlet, and in some embodiments the air filtering member comprises a screen.

In some embodiments the turbo brush further comprises a second air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades.

In some embodiments the secondary airflow path downstream of the air driven turbine has a cross sectional area greater than a cross sectional area of a flow path through the blades of the air driven turbine, and in some embodiments the cowling is generally centrally located in the secondary airflow path downstream of the air driven turbine and has a cross sectional area that decreases in a downstream direction.

In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the housing comprises upper and lower clam shell portions that are openable, whereby, when the clam shell portions are opened, the air filtering member is accessible.

In accordance with a sixth aspect of this disclosure, an air filtering member is positioned between the downstream side of the air driven turbine and the primary air flow path extending through the turbo brush from the dirty air inlet to the outlet of the turbo brush. While the turbo brush may be designed to utilize a clean air stream to run the air turbine, it is possible that, during use, dirt may enter the secondary clean air flow path and travel upstream towards the turbine, thereby fouling the turbine. For example, if the turbo brush is inverted or placed in another orientation, any dirt that may remain in the primary airflow path could travel towards the air turbine of the turbo brush. Accordingly, a screen or other filtering member may be positioned, e.g. at the interface of the primary and secondary airflow pass so as to inhibit such rearward flow of contaminants.

In accordance with this aspect of the disclosure, there is provided a turbo brush for cleaning a surface comprising:

(a) a housing having an upper surface, a lower surface, a front end and a rear end, the lower end having a dirty air inlet;
(b) a primary air flow path extending from the dirty air inlet to a dirty air outlet;
(c) a rotary brush associated with the dirty air inlet and extending transverse to a forward direction of movement of the turbo brush; and,
(d) a drive mechanism comprising an air driven turbine drivingly connected to the rotary brush;
(e) a secondary air flow path including the air driven turbine and extending from a clean air inlet to a position downstream from the air driven turbine; and,
(f) an air-filtering member positioned between a downstream side of the air driven turbine and the primary airflow path.

In some embodiments the drive mechanism comprises a drive gear drivingly connected to the rotary brush and a worm gear directly drivingly connecting the air driven turbine and the drive gear.

In some embodiments the air driven turbine is a clean air turbine.

In some embodiments the secondary airflow path joins the primary airflow path upstream of the dirty air outlet.

In some embodiments the secondary airflow path from the clean air inlet to a position downstream of the air driven turbine is generally linear.

In some embodiments, the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends.

In some embodiments the rotary brush comprises first and second portions and the drive gear is positioned between the first and second portions, and in some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments, the turbo brush further comprises an additional air filtering member positioned upstream of the air driven turbine, and in some embodiments the additional air filtering member comprises a screen.

In some embodiments, the turbo brush further comprises a second air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades.

In some embodiments the secondary airflow path downstream of the air driven turbine has a cross sectional area greater than a cross sectional area of a flow path through the blades of the air driven turbine. In some embodiments the cowling is generally centrally located in the secondary airflow path downstream of the air driven turbine and has a cross sectional area that decreases in a downstream direction. In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet.

In some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the housing comprises upper and lower clam shell portions that are openable, whereby, when the clam shell portions are opened, the additional air filtering member is accessible.

In accordance with a seventh aspect of this disclosure, a turbo brush may be provided with the storage area in the primary airflow path. The storage area may, e.g., have a recessed lower surface so as to provide a storage area for heavier material that is drawn into the dirty air inlet but wherein the velocity of the air flow through the primary airflow path may be insufficient to draw the material to the air treatment member (e.g., a cyclone) of the surface cleaning apparatus. Instead of such material falling out the dirty air inlet, it may be stored in the turbo brush. The storage area is preferably openable to permit the storage area to be emptied. When the turbo brush is raised above a surface to be treated, airflow through the primary airflow path may increase due to a reduced load on the rotary brush. In such a case, some of the material in the storage area may then be entrained in the higher airflow travelling through the primary airflow path thereby avoiding the need to open the storage area to permit the storage area to be emptied. The storage area may be emptied by opening a door or by separating upper and lower clam shell portions as discussed herein.

In accordance with this aspect of the disclosure, there is provided a turbo brush for cleaning a surface comprising:

(a) a housing having an upper surface, a lower surface, a front end and a rear end, the lower end having a dirty air inlet;
(b) a primary air flow path having a lower surface and extending from the dirty air inlet to a dirty air outlet; and,
(c) a rotary brush associated with the dirty air inlet and extending transverse to a forward direction of movement of the turbo brush;
(d) a drive mechanism comprising an air driven turbine drivingly connected to a worm gear and a worm gear drivingly connected to a drive gear provided with the rotary brush; and,
(e) a storage area having a recessed lower surface provided in the primary airflow path.

In some embodiments the recessed lower surface has an upstream end and a downstream end, the upstream end positioned below a portion of the lower surface that is immediately upstream of the upstream end of the recessed lower surface.

In some embodiments the worm gear directly drivingly connects the air driven turbine and the drive gear.

In some embodiments the air driven turbine is a clean air turbine.

In some embodiments, the turbo brush further comprises a secondary airflow path including the air driven turbine and extending from a clean air inlet to a position downstream from the air driven turbine.

In some embodiments the secondary airflow path joins the primary airflow path upstream of the dirty air outlet, and in some embodiments the secondary airflow path from the clean air inlet to a position downstream of the air driven turbine is generally linear.

In some embodiments, the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends.

In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments, the turbo brush further comprises an air filtering member adjacent the clean air inlet, and in some embodiments the air filtering member comprises a screen.

In some embodiments, the turbo brush further comprises an air filtering member positioned between a downstream side of the air driven turbine and the primary air flow path.

In some embodiments the air driven turbine has turbine blades and an associated depressurization zone downstream thereof and the turbo brush further comprises a cowling downstream of the air driven turbine and positioned such that the depressurization zone is located downstream of the turbine blades.

In some embodiments, the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction.

In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments, the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with an eighth aspect of this disclosure, a cowling is provided downstream of the air driven turbine. The cowling is positioned such that the depressurization zone is located downstream of the turbine blades. As air passes through an air driven turbine, the air is compressed due to the reduced cross-section area available for airflow. Once the air passes through the blades of the turbine, the cross-section area of the flow path increases. This increase in cross-section area results in a pressure drop. This pressure drop occurs in the depressurization zone. If a portion of the depressurization zone is internal of the blades of the air turbine, then the amount of power provided to the vanes of the turbine by the air passing therethrough is reduced. The cowling may be used to alter the position of the depressurization zone so that all of the depressurization zone is positioned downstream of the turbine. Accordingly, the maximum pressure is maintained in the blades of the turbine thereby preventing a reduction in drive power provided to the turbine due to the air flow therethrough.

In accordance with this aspect of the disclosure, there is provided a turbo brush for cleaning a surface comprising:

(a) a housing having an upper surface, a lower surface, a front end and a rear end, the lower end having a dirty air inlet;

(b) a primary air flow path extending from the dirty air inlet to a dirty air outlet;

(c) a rotary brush associated with the dirty air inlet and extending transverse to a forward direction of movement of the turbo brush;

(d) a drive mechanism comprising an air driven turbine drivingly connected to the rotary brush, wherein the air driven turbine has turbine blades and an associated depressurization zone downstream thereof; and, (e) a cowling downstream of the air driven turbine and positioned such that the depressurization zone is located downstream of the turbine blades.

In some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction. In some embodiments the cowling is generally bullet nosed in shape, and in some embodiments the cowling is asymmetrically shaped.

In some embodiments the air driven turbine is a clean air turbine.

In some embodiments the turbo brush further comprises a secondary airflow path including the air driven turbine and extending from a clean air inlet to a position downstream from the air driven turbine. In some embodiments the secondary airflow path joins the primary airflow path upstream of the dirty air outlet. In some embodiments the secondary airflow path from the clean air inlet to a position downstream of the air driven turbine is generally linear. In some embodiments the cowling includes a plurality of vanes extending in a direction of flow of air in the secondary air flow path immediately downstream of the air driven turbine. In some embodiments the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends.

In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In some embodiments the drive mechanism comprises a drive gear drivingly connected to the rotary brush and a worm gear directly drivingly connecting the air driven turbine and the drive gear.

In accordance with a ninth aspect of this disclosure, a clean air driven turbine is provided in the turbo brush. The turbine is driven by a secondary clean airflow stream. This secondary clean airflow stream is configured to join or merge with a primary airflow path (i.e. the dirty air flow stream) downstream of the depressurization zone. If the position at which the secondary air flow path joins the primary dirty air flow path is too close to the turbine, then dirt or other material may be drawn into the secondary clean airflow path. This material may foul the turbine.

In accordance with this aspect of the disclosure, there is provided a turbo brush for cleaning a surface comprising:

(a) a housing having an upper surface, a lower surface, a front end and a rear end, the lower end having a dirty air inlet;
(b) a primary air flow path extending from the dirty air inlet to a dirty air outlet;
(c) a rotary brush associated with the dirty air inlet and extending transverse to a forward direction of movement of the turbo brush;
(d) a drive mechanism comprising an air driven turbine drivingly connected to the rotary brush; and,
(e) a secondary air flow path including the air driven turbine and extending from a clean air inlet to a position downstream from the air driven turbine, the air driven turbine has an associated depressurization zone downstream thereof and the secondary airflow path joins the primary airflow path downstream of the depressurization zone.

In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the drive mechanism comprises a drive gear drivingly connected to the rotary brush and a worm gear directly drivingly connecting the air driven turbine and the drive gear.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends.

In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the air driven turbine is a clean air turbine.

In some embodiments the secondary airflow path joins the primary airflow path upstream of the dirty air outlet.

In some embodiments the secondary airflow path from the clean air inlet to a position downstream of the air driven turbine is generally linear.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the turbo brush further comprises a cowling downstream of the air driven turbine and positioned such that the depressurization zone is located downstream of the turbine blades.

In some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction.

In some embodiments the cowling is generally bullet nosed in shape, and in some embodiments the cowling is asymmetrically shaped.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with a tenth aspect of this disclosure, an air driven turbine of the turbo brush may be powered by a clean air stream wherein the outlet of the clean air stream is positioned at the dirty air inlet. Accordingly, clean air will be drawn through the turbine so as to power a rotary brush. The clean air may then travel through a conduit in the turbo brush to an outlet located adjacent to the dirty air inlet (e.g. in front thereof). Accordingly, the air exiting the clean air outlet may then be drawn through the dirty air inlet so as to assist in entraining dirt. An advantage of this design is that, when a turbo brush is raised above a surface, air will be drawn only through the dirty air inlet and not the air inlet of the clean secondary air flow path. Accordingly, the air driven turbine will be effectively turned off when the turbo brush is raised above the surface to be cleaned. Further, the amount of air flow through the dirty air inlet may be increased by directing the clean air flow stream to the dirty air inlet.

In accordance with this aspect of the disclosure, there is provided a turbo brush for cleaning a surface comprising:

(a) a housing having an upper surface, a lower surface, a front end and a rear end, the lower end having a dirty air inlet;

(b) a primary air flow path extending from the dirty air inlet to a dirty air outlet;

(c) a rotary brush associated with the dirty air inlet and extending transverse to a forward direction of movement of the turbo brush;

(d) a drive mechanism comprising an air driven turbine drivingly connected to the rotary brush; and, (e) a secondary air flow path including the air driven turbine and extending from a clean air inlet to a position downstream from the air driven turbine, wherein the secondary airflow path has a secondary air flow path outlet at the dirty air inlet.

In some embodiments the secondary airflow path outlet is positioned forward of the rotary brush.

In some embodiments the drive mechanism comprises a drive gear drivingly connected to the rotary brush and a worm gear directly drivingly connecting the air driven turbine and the drive gear.

In some embodiments the air driven turbine is a clean air turbine.

In some embodiments the turbo brush further comprises a secondary airflow path including the air driven turbine and extending from a clean air inlet to a position downstream from the air driven turbine.

In some embodiments the secondary airflow path joins the primary airflow path upstream of the dirty air outlet.

In some embodiments the secondary airflow path from the clean air inlet to a position downstream of the air driven turbine is generally linear.

In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends.

In some embodiments the drive gear is positioned at a midpoint between the opposed ends.

In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet.

In some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface.

In some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades.

In some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction.

In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

In some embodiments the housing comprises upper and lower clam shell portions that are openable.

In some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with another an eleventh of this disclosure, the leading or front face of the turbo brush is provided with a number of channels or raised sections. The cleaning efficiency of a turbo brush depends upon the velocity of air flow at the dirty air inlet. Accordingly, it is preferred to have a relatively small gap between the lower surface of a turbo brush and the surface to be cleaned. Reducing this height will increase the velocity of the air flow entering the dirty air inlet of the turbo brush. This feature is particularly important for a clean air turbo brush since some of the air flow created by the suction motor is drawn through the secondary clean air flow path. However, if the gap is too narrow, large particles of dirt or the like may not be able to pass underneath the turbo brush and enter the dirty air inlet in the lower surface thereof. Providing a plurality of discrete channels along the leading face and/or side of the turbo brush, which extend to the dirty air inlet, provide a path for such larger particles to travel under the turbo brush to the dirty air inlet. Accordingly, the channels enable the turbo brush to collect larger dirt particles without raising the leading edge of the turbo brush to such an extent that the air flow at the dirty air inlet will be substantially reduced.

In accordance with this aspect, there is provided a turbo brush for cleaning a surface comprising:

(a) a housing having an upper surface, a lower surface, a front end and a rear end, the lower end having a dirty air inlet;

(b) a primary air flow path extending from the dirty air inlet to a dirty air outlet;

(c) a rotary brush associated with the dirty air inlet and extending transverse to a forward direction of movement of the turbo brush; and, (d) a drive mechanism comprising an air driven turbine drivingly connected to the rotary brush wherein, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the raised sections extend rearwardly to the dirty air inlet.

In some embodiments the turbo brush further comprises a drive gear drivingly connected to the rotary brush and the worm gear directly drivingly connects the air driven turbine and the drive gear.

In some embodiments the air driven turbine is a clean air turbine.

In some embodiments the turbo brush further comprises a secondary airflow path including the air driven turbine and extending from a clean air inlet to a position downstream from the air driven turbine.

In some embodiments the secondary airflow path joins the primary airflow path upstream of the dirty air outlet.

In some embodiments the secondary airflow path from the clean air inlet to a position downstream of the air driven turbine is generally linear.

In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted co-axial with the rotary brush.

In some embodiments the rotary brush has transversely opposed first and second opposed ends and the drive gear is position between the opposed ends, and in some embodiments the drive gear is positioned at a midpoint between the opposed ends.

In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface.

In some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades.

In some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction.

In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet, and in some embodiments the secondary airflow path outlet is positioned forward of the rotary brush.

In some embodiments the housing comprises upper and lower clam shell portions that are openable, and in some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path and the housing comprises upper and lower clam shell portions that are openable, whereby, when the clam shell portions are opened, the air filtering member is accessible.

In accordance with a twelfth aspect of this disclosure, a turbo brush is provided which is constructed from upper and lower clam shell portions which are openable. For example, if the turbo brush is provided with a storage area, the claim shell portions may be separated thereby enabling the storage area to be emptied. Similarly, if a screen or other filter member is provided between the secondary air flow path downstream of the turbine and the primary air flow path, this screen may be accessed for cleaning or replacement as needed.

In accordance with this aspect, there is provided a turbo brush for cleaning a surface comprising:

(a) a housing comprising upper and lower clam shell portions that are openable, the upper clam shell having an upper surface, the lower clam shell having a lower surface, (b) a front end and a rear end, the lower end having a dirty air inlet;

(c) a primary air flow path extending from the dirty air inlet to a dirty air outlet;

(d) a rotary brush associated with the dirty air inlet and extending transverse to a forward direction of movement of the turbo brush; and, (e) a drive mechanism comprising an air driven turbine drivingly connected to the rotary brush.

In some embodiments the primary airflow path has a lower surface, and the primary airflow path includes a storage area having a recessed lower surface whereby, when the clam shell portions are opened, the storage area is accessible.

In some embodiments the turbo brush further comprises an air filtering member positioned between a downstream side of the air driven turbine and the primary air flow path, whereby, when the clam shell portions are opened, the air filtering member is accessible.

In some embodiments the turbo brush further comprises a drive gear drivingly connected to the rotary brush and a worm gear directly drivingly connects the air driven turbine and the drive gear.

In some embodiments the air driven turbine is a clean air turbine.

In some embodiments the turbo brush further comprises a secondary airflow path including the air driven turbine and extending from a clean air inlet to a position downstream from the air driven turbine.

In some embodiments the secondary airflow path joins the primary airflow path upstream of the dirty air outlet.

In some embodiments the secondary airflow path from the clean air inlet to a position downstream of the air driven turbine is generally linear.

In some embodiments the turbo brush further comprises a cowling downstream of the air driven turbine and positioned in the secondary air flow path wherein the cowling includes a plurality of vanes extending in a direction of flow of air in the secondary air flow path immediately downstream of the air driven turbine.

In some embodiments the rotary brush is positioned proximate the front end.

In some embodiments the drive gear has an axis parallel to an axis of rotation of the rotary brush, and in some embodiments the drive gear is mounted coaxial with the rotary brush.

In some embodiments the rotary brush has transversely opposed first and second opposed ends and the drive gear is position between the opposed ends, and in some embodiments the drive gear is positioned at a midpoint between the opposed ends. In some embodiments the rotary brush comprises first and second portions and the drive gear is positioned between the first and second portions.

In some embodiments the rotary brush is provided with a plurality of bristles, the worm gear has a drive end drivingly engaging the drive gear and the drive end is positioned radially inwardly of an outer radial extent of the bristles.

In some embodiments the rotary brush comprises a plurality of bristles and the bristles extend at an angle so as to engage a portion of the surface that is directly beneath the drive end of the worm gear.

In some embodiments the turbo brush further comprises an air filtering member adjacent the clean air inlet, and in some embodiments the air filtering member comprises a screen.

In some embodiments the turbo brush further comprises an air filtering member positioned between a downstream side of the air driven turbine and the primary air flow path.

In some embodiments the primary airflow path has a lower surface, and the primary airflow path includes a storage area having a recessed lower surface, and in some embodiments the recessed lower surface has an upstream end and a downstream end, the upstream end positioned below a portion of the lower surface that is immediately upstream of the upstream end of the recessed lower surface.

In some embodiments the air driven turbine has turbine blades and an associated depressurization zone downstream thereof and the turbo brush further comprises a cowling downstream of the air driven turbine and positioned such that the depressurization zone is located downstream of the turbine blades.

In some embodiments the turbo brush further comprises an airflow path downstream of the air driven turbine, the airflow path downstream of the air driven turbine having a cross sectional area greater than a cross sectional area of a flow path through the blades of the air driven turbine.

In some embodiments the cowling is generally centrally located in the airflow path downstream of the air driven turbine and has a cross sectional area that decreases in a downstream direction.

In some embodiments the cowling is generally bullet nosed in shape, and in some embodiments the cowling is asymmetrically shaped.

In some embodiments the air driven turbine has an associated depressurization zone downstream thereof and the secondary airflow path joins the primary airflow path downstream of the depressurization zone.

In some embodiments the primary air flow path has a primary cross sectional area and the air driven turbine has a flow path therethrough having a turbine flow path cross sectional area and the ratio of the primary cross sectional area to the turbine flow path cross sectional area is between 4:1-1:4, or between 4:1-1:1, or between 2:1-1:2.

In some embodiments the secondary airflow path has a secondary air flow path outlet at the dirty air inlet.

In some embodiments the secondary airflow path outlet is positioned forward of the rotary brush.

In some embodiments, when the turbo brush is positioned on a flat surface, an air inflow path is defined between the flat surface and the lower surface forward of the rotary brush, the lower surface forward of the rotary brush extends transversely to a forward direction of motion and has raised sections along its length such that the air inflow path has portions having an increased height along the length of the lower surface.

In some embodiments the lower surface forward of the rotary brush has a plurality of rearwardly extending raised sections.

It will be appreciated that each of these aspects may be utilized individually or all or any sub-combination thereof, may be utilized in any particular turbo brush.

DRAWINGS

These and other advantageous will be understood in accordance with the following detailed description of the accompanying drawings in which.

DETAILED DESCRIPTION

Figure 1:
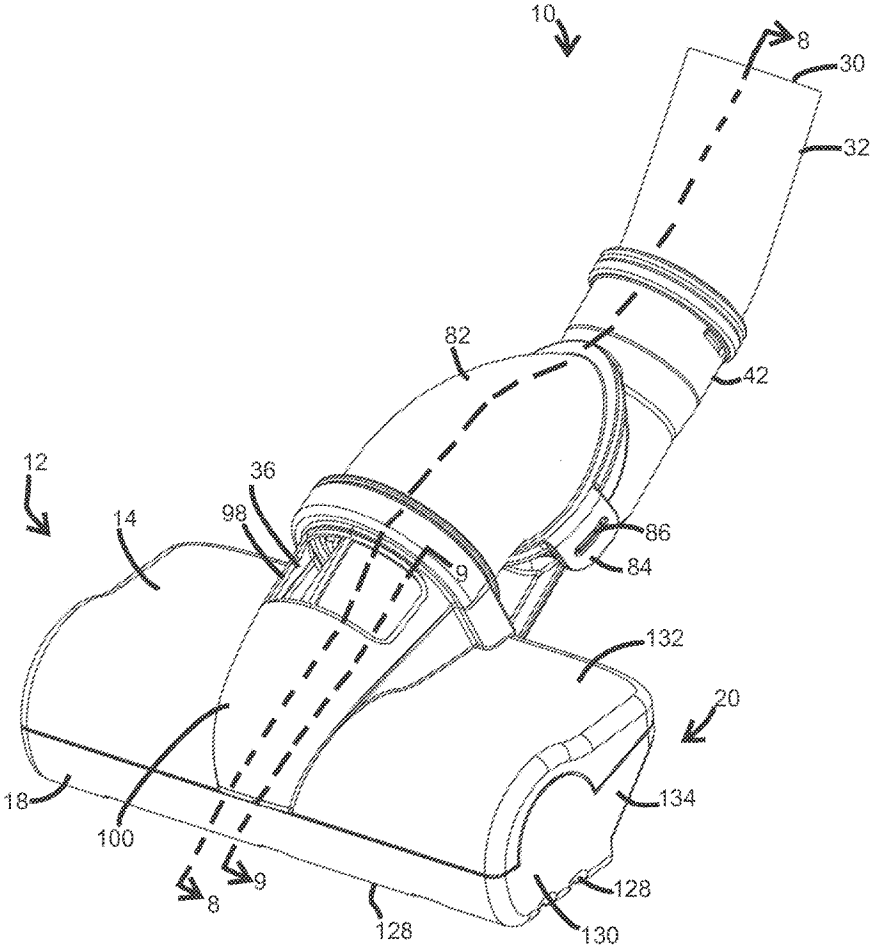
FIG. 1 is a front perspective view of a turbo brush.
Figure 2:
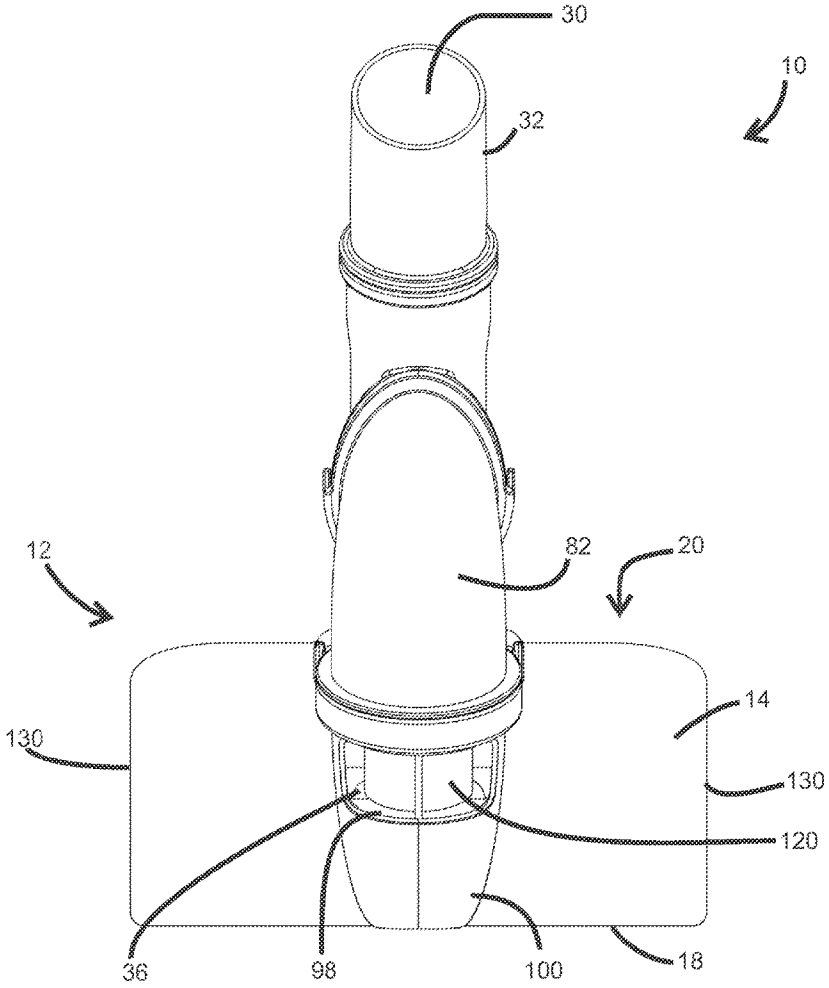
FIG. 2 is a top plan of the turbo brush of FIG. 1.
Figure 3:
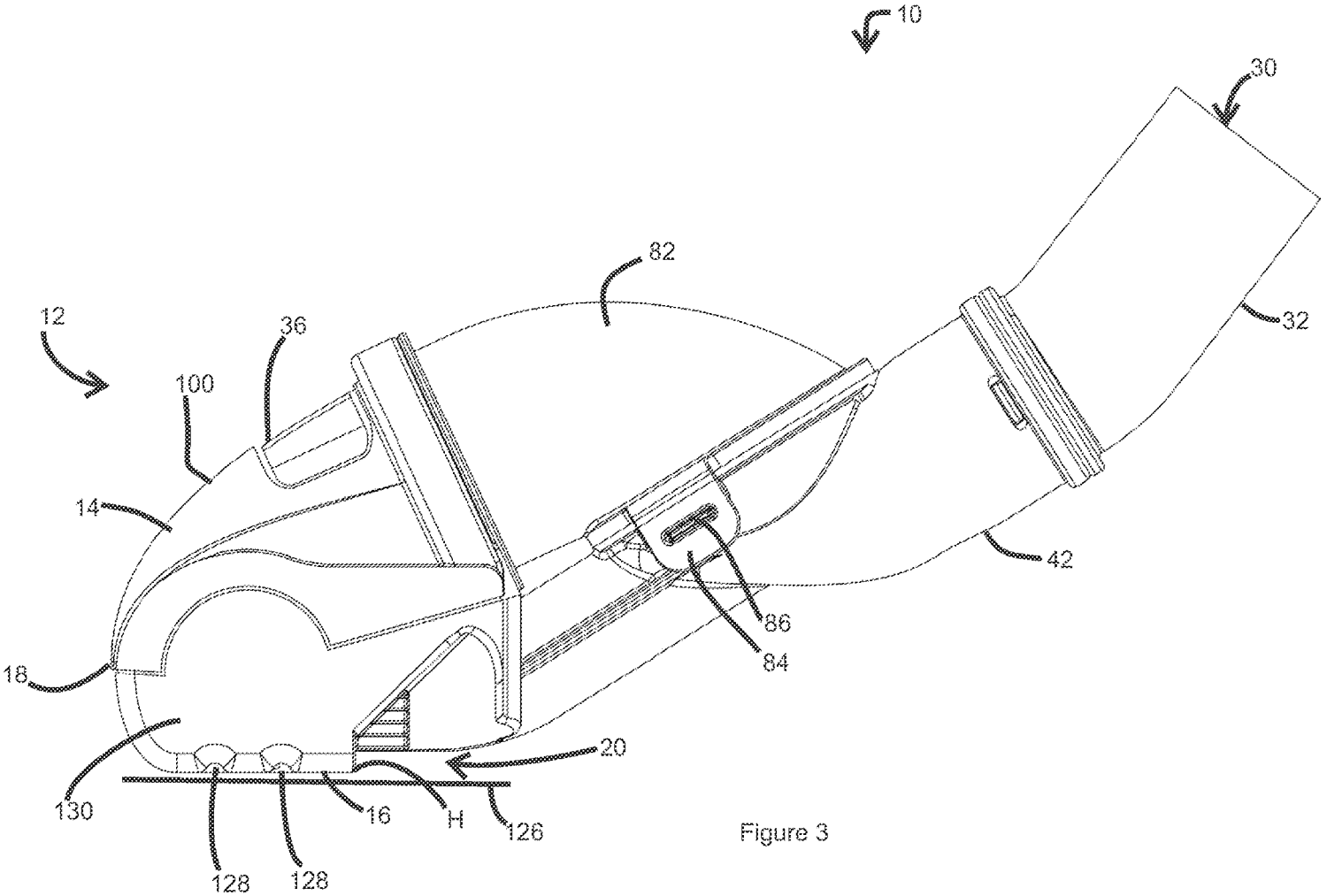
FIG. 3 is a side elevation view of the turbo brush of FIG. 1.

This detailed description discloses various features of turbo brush 10. It will be appreciated that an embodiment may use one or more of these features. The turbo brush may be used with any surface cleaning apparatus known in the art, such as a hand operable surface cleaning apparatus, an upright vacuum cleaner, a stick vac, a wet-dry vacuum cleaner and a carpet extractor.

As exemplified in FIGS. 1-5, turbo brush 10 comprises a housing 12 having an upper surface 14, a lower surface 16, front end 18 and rear end 20. It will be appreciated that housing 12 may be of any particular shape and configuration. Housing 12 is provided with a dirty air inlet 22 provided in lower surface 16. Dirty air inlet 22 may be of any particular configuration known in the art and preferably extends across the entire width or essentially the entire width of the turbo brush. Dirty air inlet 22 preferably extends transverse to a forward direction of motion of turbo brush 10. Further, dirty air inlet 22 is preferably provided towards the front end 18 and preferably adjacent front end 18

A rotary brush 24 is associated with dirty air inlet and is preferably mounted there above. As exemplified, rotary brush 24 preferably extends across the entire width of dirty air inlet 22 and is provided with a plurality of bristles 26. Bristles 26 are shown in a stylized form and may be of any type known in the art. As exemplified in FIG. 8, turbo brush 10 has a primary air flow path 28 that extends from dirty air inlet 22 to dirty air outlet 30. Primary air flow path 28 may be of various configurations which are known in the art. As exemplified in FIG. 8 arrows A show a schematic path through the primary airflow path 28. As exemplified, dirty air outlet 30 is provided at the end of conduit 32, which may be the up-flow duct for a surface cleaning apparatus. It will be appreciated that dirty air outlet 30 may be provided at alternate locations.

Figure 8:
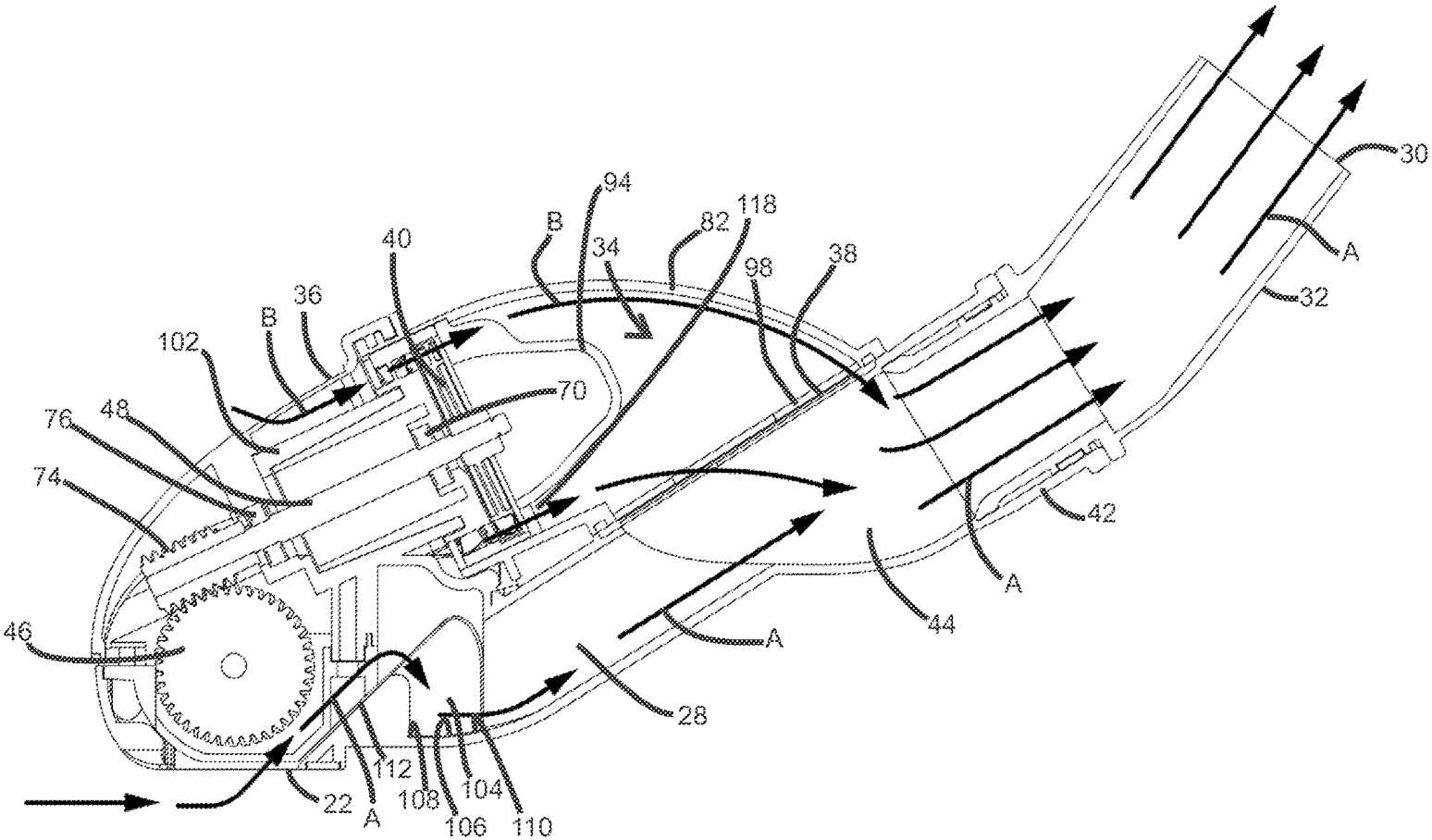
FIG. 8 is a cross section along the line 8-8 of FIG. 1.

Preferably, turbo brush 10 utilizes a secondary clean air flow path to drive air turbine 40. Accordingly, as exemplified in FIG. 8, secondary airflow path may extend from a clean air inlet 36 through turbine 40 to clean air outlet 38. In FIG. 8, secondary air flow path 34 is exemplified by arrows B. As exemplified in FIG. 8, primary and secondary airflow paths 28 and 34 merge or combine downstream of turbine 40 at conduit 42 and continue upstream through conduit 32 to dirty air outlet 30. Conduit 42 includes a plenum 44 where the primary and secondary airflow streams 28, 34 merge. It is preferred that secondary air flow path 34 joins the primary air flow path 28 upstream of dirty air outlet 30.

It will be appreciated by those skilled in the art that the primary and secondary air flow paths may have separate air outlets from turbo brush 10. Further, it will be appreciated that a rigid conduit or up-flow duct 32 need not been provided. Preferably, as exemplified, conduit 32 is provided and is rotatably mounted to conduit 42 so as to enhance the maneuverability of turbo brush 10.

Drive Mechanism

In a preferred embodiment, the drive mechanism of the turbo brush comprises air driven turbine 40, which is preferably a clean air driven turbine as exemplified in FIG. 8, worm gear 46 which is drivingly connected to rotary brush 24 and worm 48 which drivingly connects air driven turbine 40 and worm gear 46 (see for example FIGS. 6-10).

Figure 4:
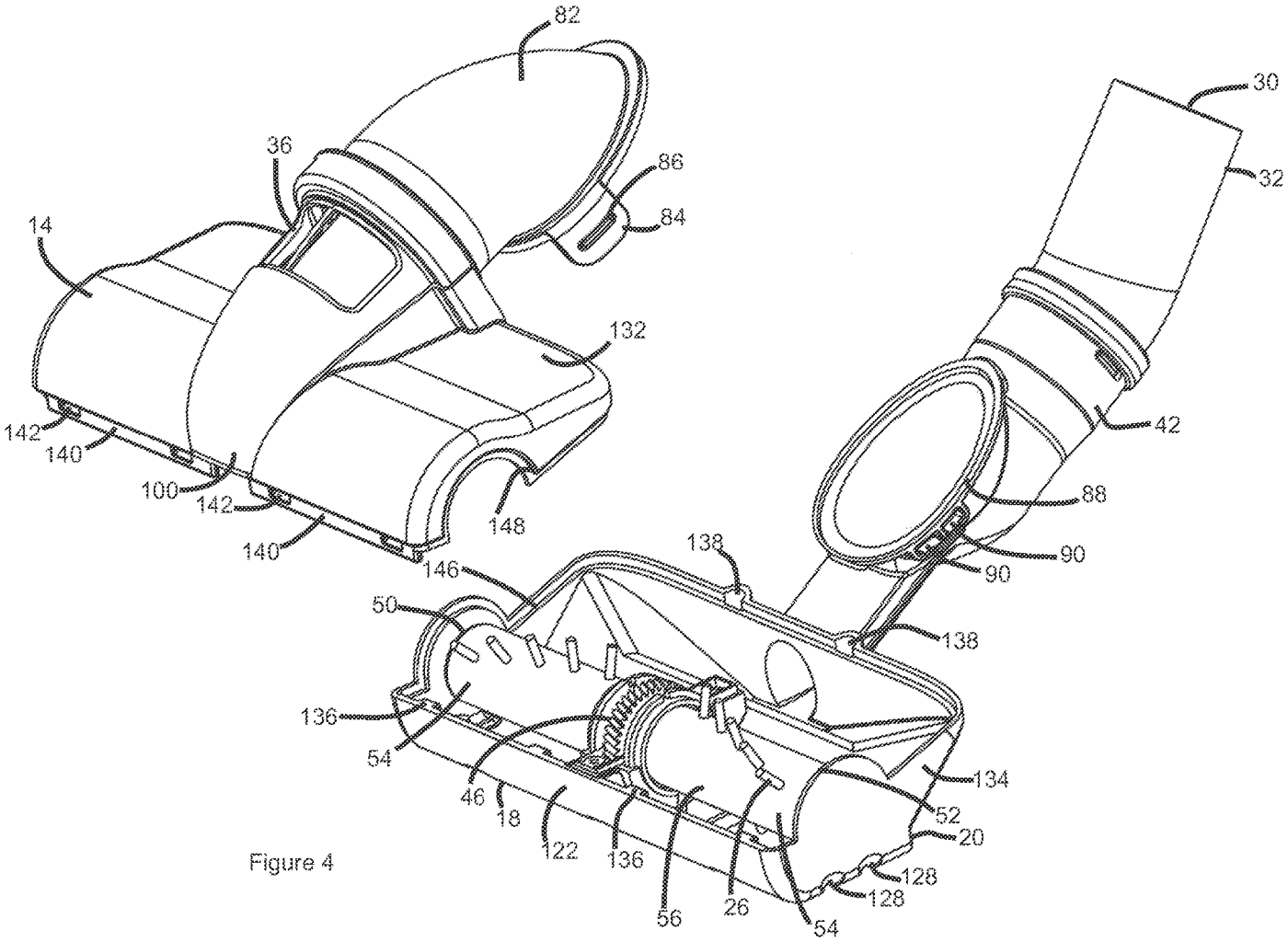
FIG. 4 is a partially exploded view from above of the turbo brush of FIG. 1.
Figure 5:
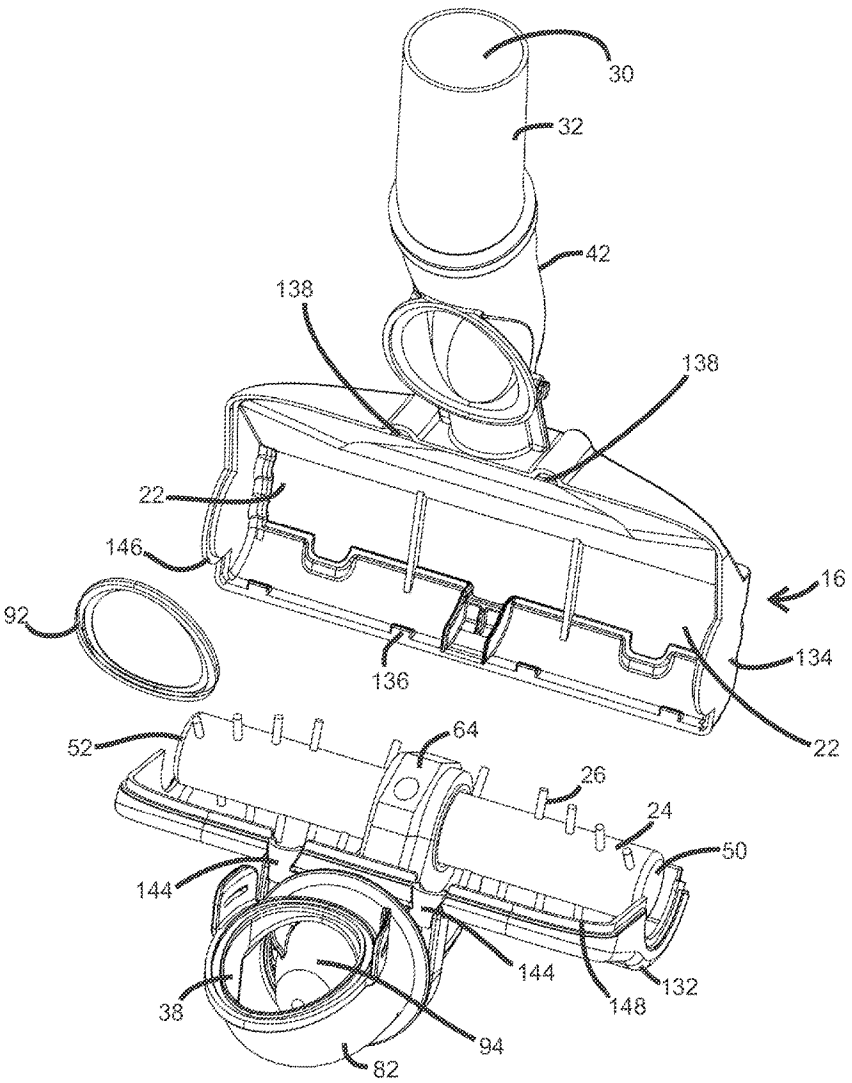
FIG. 5 is a partially exploded view from below of the turbo brush of FIG. 1.
Figure 6:
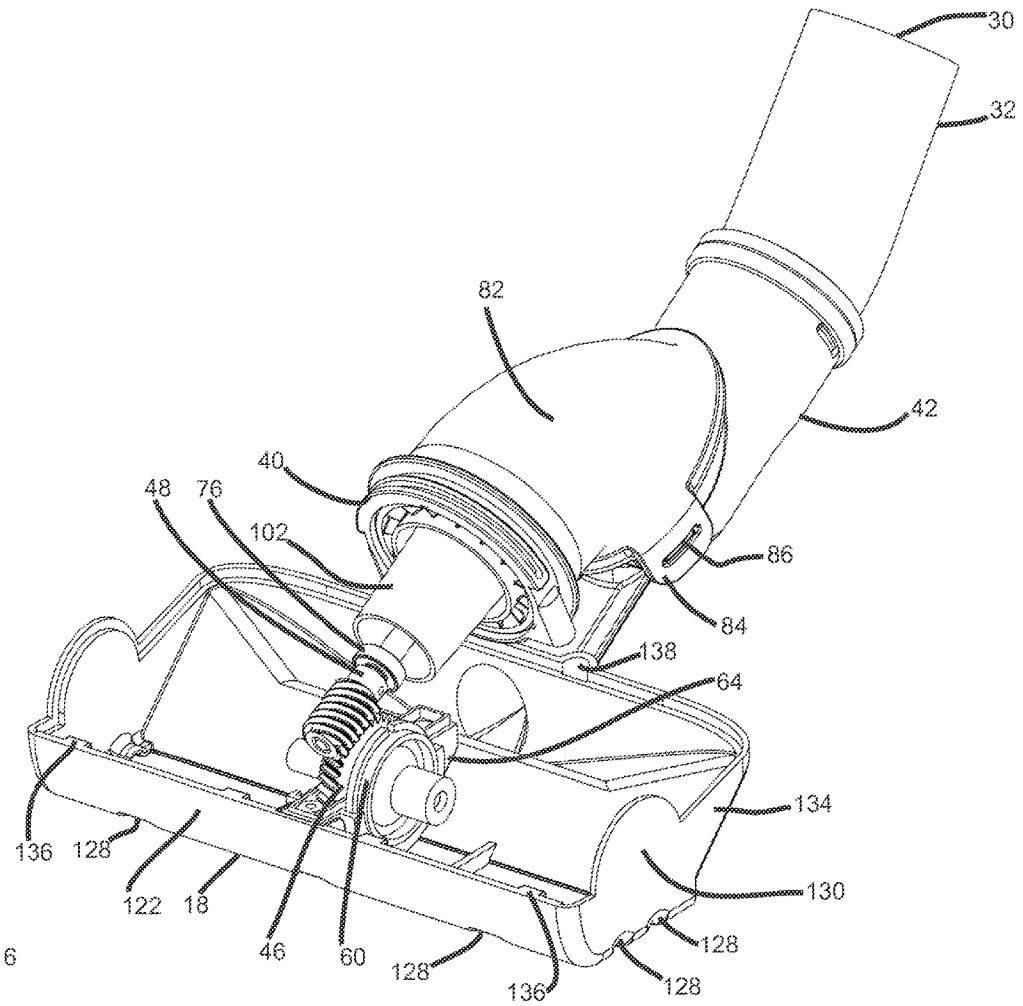
FIG. 6 is a top perspective view of the turbo brush of FIG. 1 with the upper clam shell portion and the rotary brush removed so as to show the worm gear.
Figure 7:
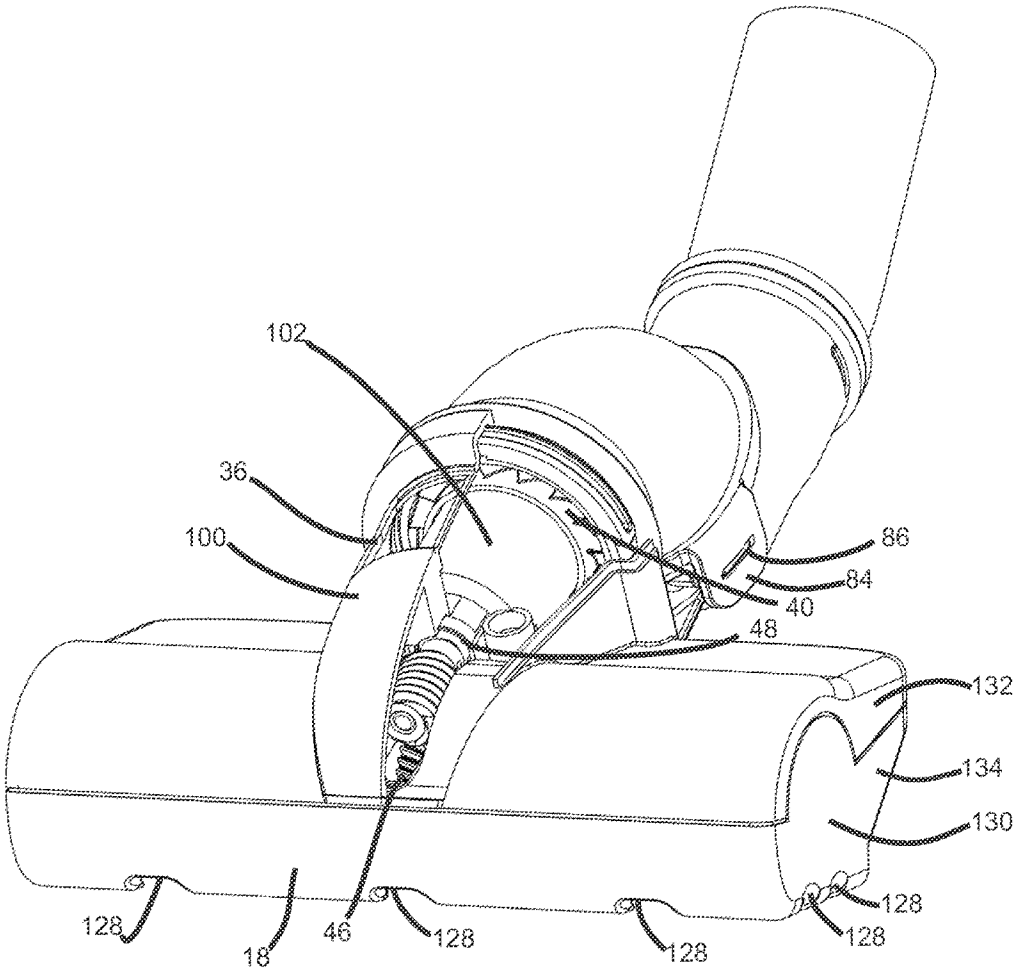
FIG. 7 is a partially cut away front perspective view of the turbo brush of FIG. 1.
Figure 12:
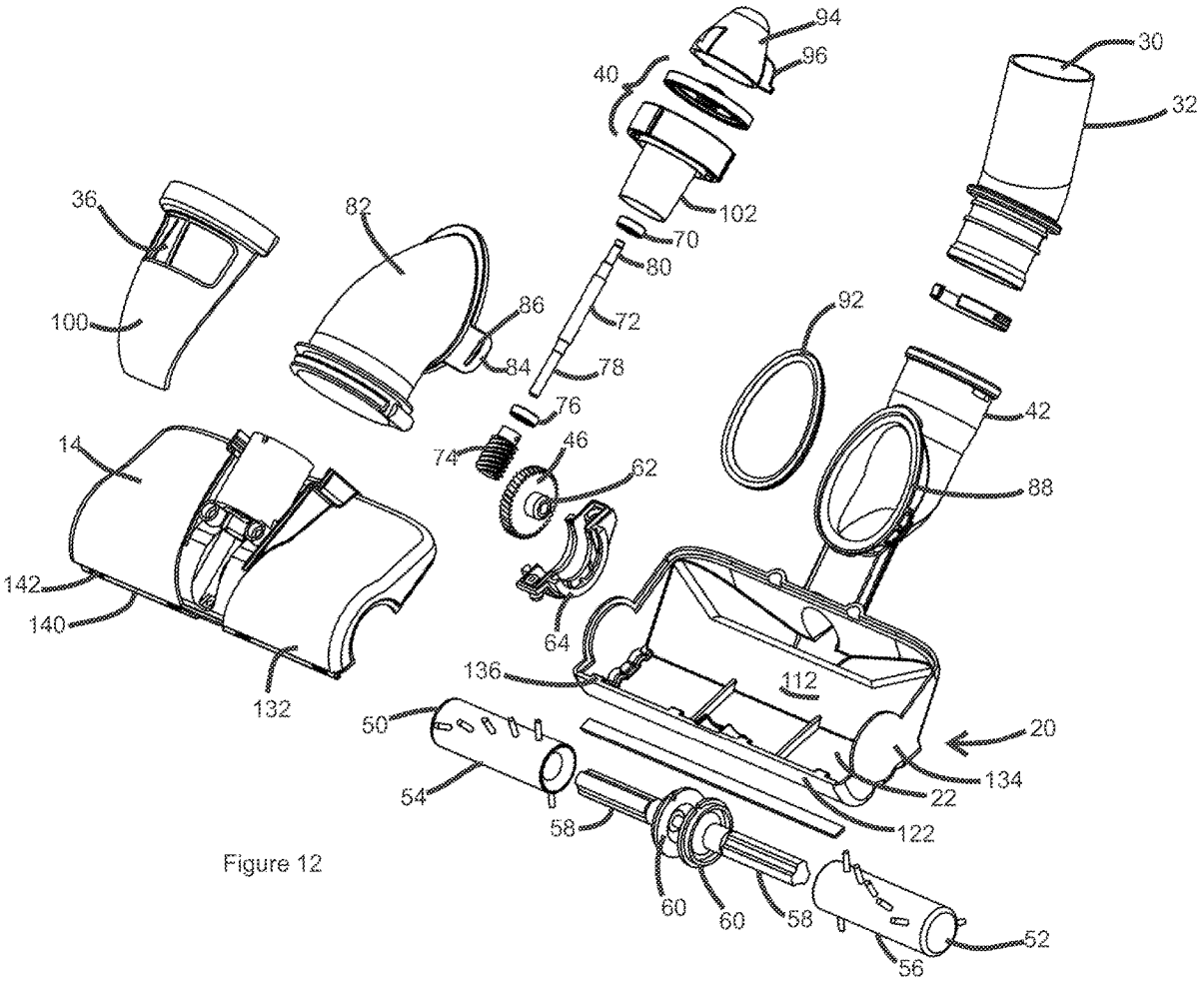
FIG. 12 is an exploded view of the turbo brush of FIG. 1.

As shown in FIGS. 4 and 6, worm gear 46 is positioned at an intermediate position, and preferably essentially, between transversely opposed first and second opposed ends 50 and 52 of rotary brush 24. Referring to FIG. 12, rotary brush 24 may comprise first and second halves or portions 54, 56, each of which may be non-rotatably mounted on a shaft or axial 58 and end members 60 may be provided to seal the interior of first and second halves 54, 56. Rotary brush 24 may be mounted for rotation in housing 12 using bearings or other means known in the art.

Worm gear 48 may be provided with a hub 62 provided on each opposed face thereof. Hubs 62 may be adapted for non-rotationally receiving a portion of shaft 58 when worm gear 46 is positioned between end members 60. For example, worm gear 46 may be non-rotationally mounted by means of a set screw, welding, splined shaft or the like. When assembled, axles 48, first and second halves 54, 46, end members 60 and worm gear 46 provide a unitary construction, which is rotatably mounted as a unit in housing 12. Accordingly, it will be appreciated that any rotary motor force supplied to worm gear 46 will cause rotary brush 24 to rotate.

In order to protect worm gear 46, a lower shroud 64 may be provided. As exemplified in FIG. 5, lower shroud surrounds the lower surface of worm gear 46. Accordingly, when turbo brush 10 is positioned on a carpet, lower shroud 64 will inhibit carpet fibers, hair or the like from encountering worm gear 46 thereby inhibiting the fouling of worm gear 46.

Figure 11:
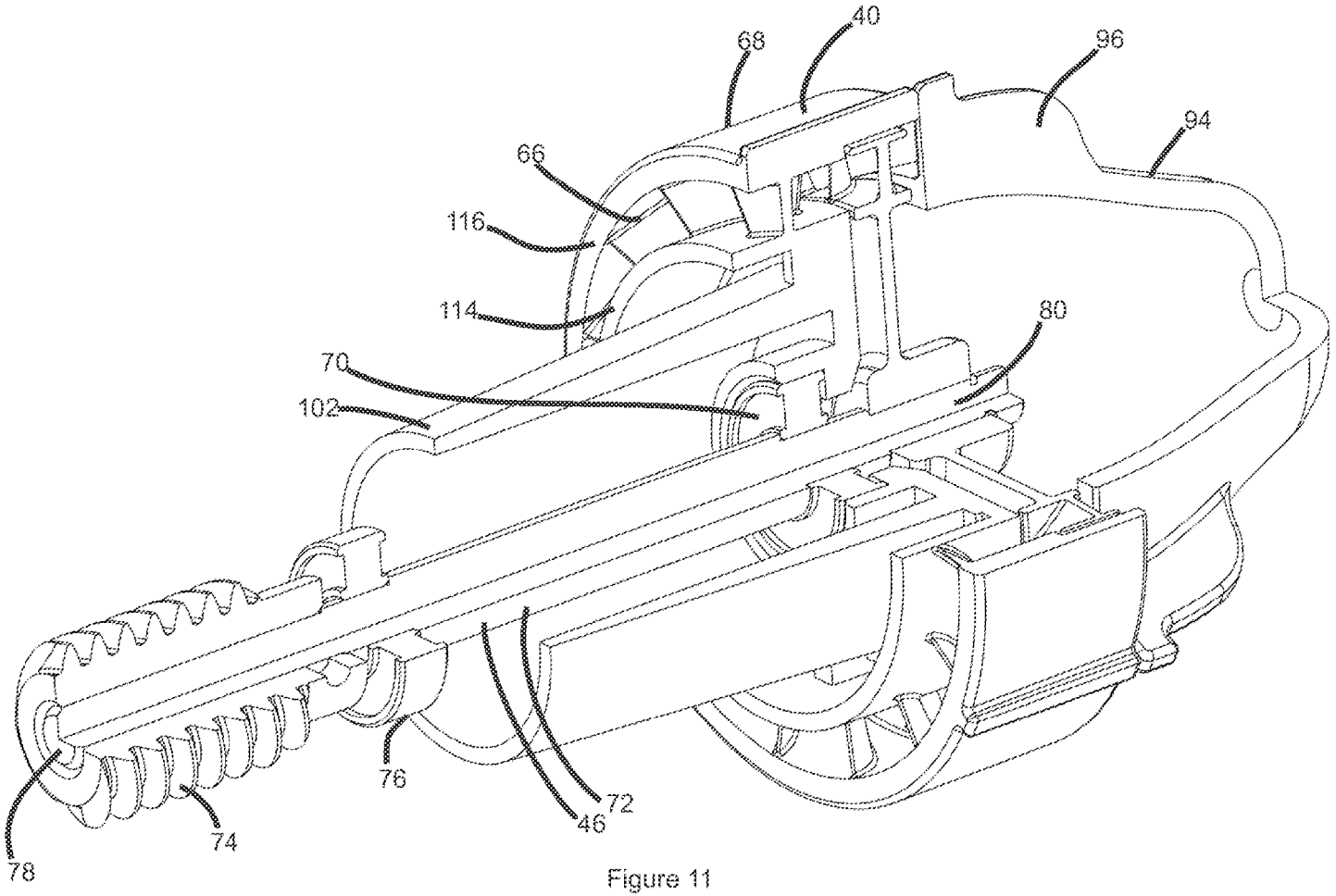
FIG. 11 is a partial cross-section through the turbo brush and worm in accordance with the aspect of this invention.

As exemplified in FIG. 11, worm comprises a shaft 72 having proximal and distal ends 78, 80. Proximal end 78 has a gear or drive head 74 non-rotatably mounted on proximal end 78 thereof, e.g., a set screw, a splined shaft, welding, or the like. Turbine 40 comprises a plurality of turbine blades 66 that are rotatably mounted inside turbine blade housing 68. For example, turbine blades 66 may be rotatably mounted about a bearing 70 that has a central opening. Opposed distal end 80 of shaft 72 is non-rotatably mounted in the central opening of bearing 70, such as by a set screw, welding, the use of a splined shaft or the like.

Preferably, a second bearing 76 is provided to rotatably support proximal end 78, and preferably, rearward of gear 74. As shown in FIG. 8, bearing 76 may be utilized to support proximal end 78 of shaft 72 at the desired positioned. Gear or head 74 is accordingly positioned so as to drivingly engage worm gear 46.

Accordingly, it will be appreciated that worm 48 is supported at either end by a bearing 70, 76 and positioned so as to drive worm gear 46. Accordingly, worm 48 is the only linking member drivingly connecting turbine 40 with worm gear 46, and, accordingly, directly drivingly connects turbine 40 to worm gear 46.

In accordance with this configuration, it will be appreciated that worm gear 46 has an axis of rotation that is parallel to and is preferably coaxial with the axis of rotation of rotary brush 24. Further, worm 48 has an axis of rotation that is perpendicular to the axis of rotation of rotary brush 24 and is preferably parallel to and more preferably co-axial with the axis of rotation of the turbine blades 66. As worm 48 is only supported by two bearings 70, 76 and as it is the only linking member between turbine 40 and worm gear 46, mechanical and frictional losses incurred during the transmission of motor force turbine blades 66 to worm gear 46 are minimized.

Configuration of Bristles

Figure 13:
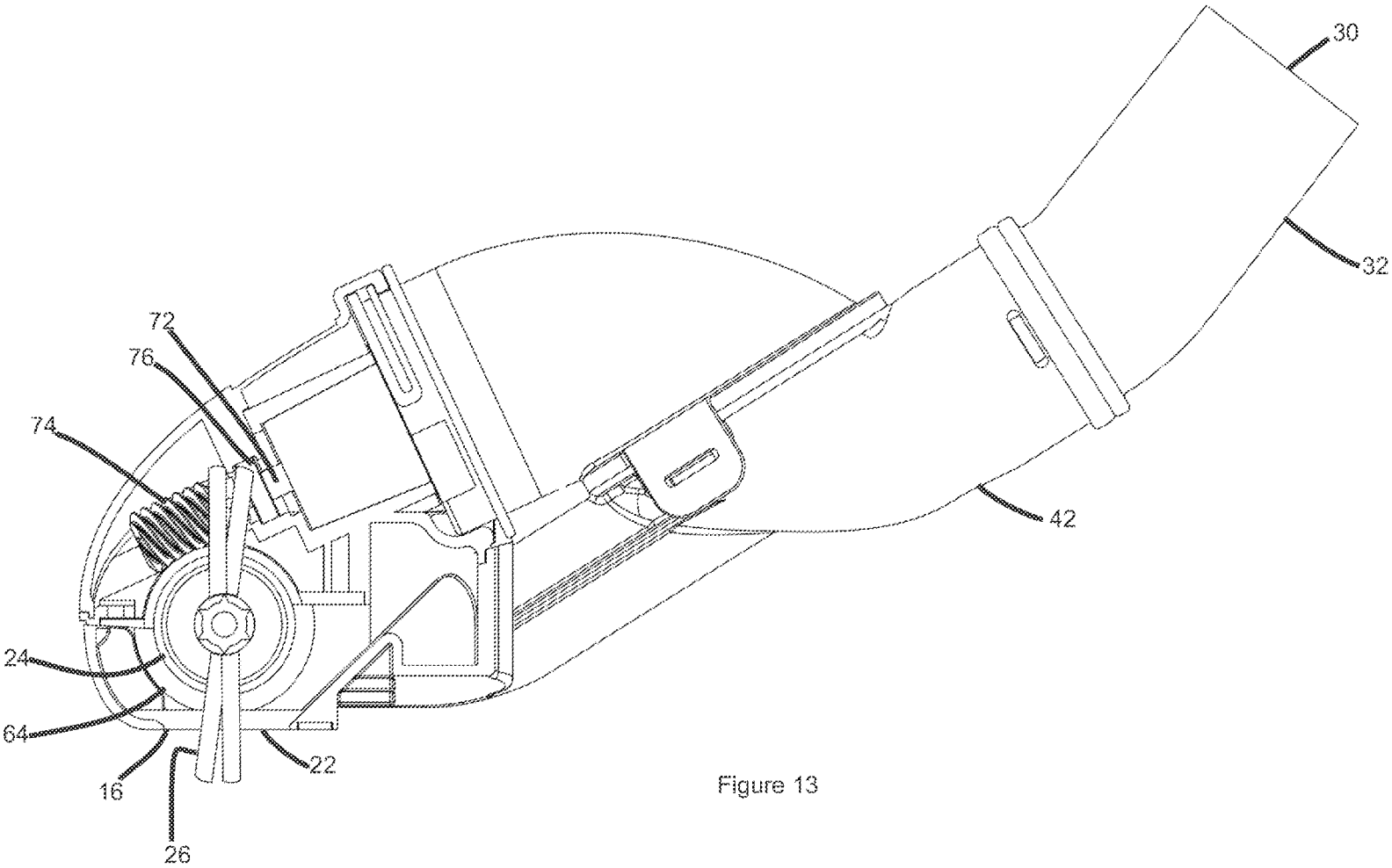
FIG. 13 is a vertical cross-section taken along the line 9-9 of FIG. 1.
Figure 14:
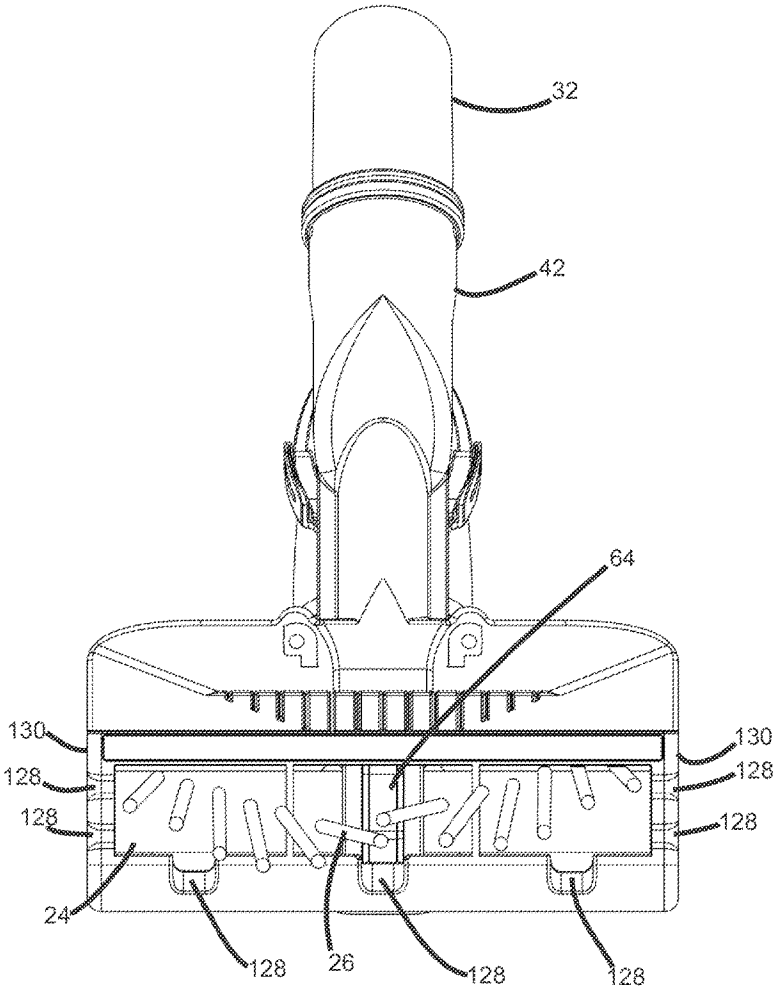
FIG. 14 is a bottom plan view of the turbo brush of FIG. 1 in accordance with an aspect of this disclosure.

It will be appreciated that if worm gear 46 is provided between opposed ends 50, 52 of rotary brush 24, then a section will be provided which does not have any bristles 26. Accordingly, if bristles 26 extend in a generally linear manner, i.e. perpendicular to brush 24, then the portion of the surface underneath drive gear 46 (or shroud 64) will not be groomed. Accordingly, bristles 26 are preferably configured so as to groom the surface beneath worm gear 46. Accordingly, bristles 26 may extend laterally at an angle from brush 24 so as to engage a portion of the surface to be cleaned that is directly beneath worm gear 46. (See for example FIG. 14). As exemplified in FIG. 13, it will be appreciated that bristles accordingly have a longitudinal extent sufficient to extend past drive gear 46 (or shroud 64) if provided so as to be able to contact the surface thereunder.

Linear Air Flow in the Secondary Air Low Path

In a preferred embodiment as exemplified in FIG. 8, once air enters clean air inlet 46, the air travels generally linearly through the secondary airflow path 34 through turbine 40 to a position downstream thereof. The airflow path downstream of turbine 40 may also be linear or essential linear. The linear air flow path through turbine 40 reduces the back pressure in the secondary air flow path.

If turbo rush 10 has a single air outlet (i.e. dirty air outlet 30), then the downstream portion of secondary air flow path 34 and/or the primary air flow path 28 is configured to combine the air flow streams. Preferably, the downstream portion of secondary air flow path 34 is configured to direct air flowing therethrough to primary air flow path 28. Preferably, as exemplified in FIG. 8, cover 82 is provided with has an arcuate surface. Accordingly, cover 82 creates an air flow conduit that causes air to be gradually redirected towards the primary air flow path. As such, cover 82 is configured so as to avoid a sharp bend such as a 90° elbow but to gently re-direct the secondary air flow path 34 to the primary air flow path 18, thereby, further reducing the back pressure through secondary air flow path 34.

Preferably, turbine 40 is provided with the shroud 102, see for example FIGS. 6 and 8. Shroud 102 covers shaft 72, thereby preventing access to shaft 72 and inhibiting dirt from fouling bearing 70. In addition, shroud 102 preferably has a smooth outer cylindrical surface so as to assist in defining a linear airflow path upstream of turbine 40.

Optionally, cover 82 may be removably mounted by any means known in the art, such as mechanical engagement means, screws or the like. Preferably, as exemplified, cover 82 is provided with a pair of opposed flanges 84 having openings 86 therein. Conduit 42 is provided with a clean air inlet 88 that has an opening configured to mate with the outlet of cover 82. One or more notches or protrusions 90 are provided on clean air inlet 88 and configured so as to be engaged in openings 86. Accordingly, cover 82 may be installed by e.g., placing a gasket 92 between the abutting faces of conduit 42 and cover 82 and applying pressure so that flanges 84 extend over protrusions 90 such that protrusions 90 are received in the openings 86. When it is desired to open cover 82, then flanges 84 may be moved laterally outwardly so as to disengage protrusions 90 from openings 86 thereby permitting cover 82 to be removed. This may be useful to provide access to turbine 40 to clean turbine 40 or to clean a filter member positioned in the air flow path as disclosed herein.

Cowling for the Air Turbine

In accordance with another preferred embodiment, a cowling 94 having a plurality of vanes 96 is preferably provided downstream of turbine 40 (see for example FIGS. 8, 9, 10, 11 and 12). The passage of air through turbine 40 will impart rotational momentum to the air flow. After air passes between blades 66 of turbine 40, the air will encounter vanes 96. Vanes 96 are configured to reduce the rotational momentum of the air exiting turbine blades 66, and, more preferably, to produce an essentially linear air flow. Vanes 96 preferably extend linearly and preferably parallel to the axis of rotation of turbine blades 66 (e.g. in the direction of the axis of shaft 72, as exemplified in FIG. 11).

It will be appreciated that any number of vanes 96 may be provided and vanes 96 may be of various configurations and length. It will also be appreciated that cowling 94 may be of various configurations and length.

An advantage of this design is that the vanes 96 will assist in producing a more linear air flow through secondary air flow path 34, thereby reducing back pressure through the secondary airflow path.

Air Filtering Members for the Secondary Airflow Path

An advantage of using a clean air turbine 40 is that dirt and other material entrained in the dirty air stream entering turbo brush 10 will not pass through turbine 40 and foul the turbine, thereby decreasing the performance of turbine. However, dirt may otherwise enter secondary air flow path 34. Accordingly, in accordance with another embodiment, an air filtering member 98 may be provided upstream and/or downstream, and preferably both upstream and downstream, of turbine 40. For example, an air filtering member 98 may be provide proximate or in overlying relation to clean air inlet 36. Similarly, a filtering member 98 may be provided in overlying relationship or at clean air inlet 88 (see FIG. 9).

Air filtering member 98 may be a screen or fine mesh. While other filter means may be utilized, the finer the pores of filtering member 98, the more back pressure will be created through the secondary airflow path 34. Preferably, the pores sizes of the filter member 98 are sufficient to block particles which can foul turbine 40. Particles fine enough to be entrained in the airflow and continue through secondary air flow path 34 are preferably not filtered. Accordingly, air filtering member 98 may be relatively porous and essentially provide no back pressure to the flow through secondary air flow path 34.

Air filtering member 98 may be of any size and configuration. Preferably, as exemplified in FIG. 1, air inlet 36 is rounded so as to provide a greater surface area for air filtering member 98. Similarly, as exemplified in FIG. 9, air filtering member 98 is arcuate or dome shaped so as to enhance the surface area thereof. The greater the surface area, the longer it will take for the air filtering member to become blocked to such an extent that the performance of turbine 40 is reduced due to increased back pressure.

It will be appreciated that air filtering member 98 provided at air inlet 36 will inhibit the entry into secondary air flow path of carpet fibers, dirt or the like which may be encountered by turbo brush 10. Air filtering member 98 provided at the outlet of cover 82 will inhibit the entry into air flow path 34 of dirt in primary air flow path 28.

As discussed previously, cover 82 may be removable. An advantage of cover 82 being removable is that access may be provided to an air filtering member 98 positioned downstream of turbine 40. Accordingly, a user may, from time to time, open cover 82 to clean air filtering member 98. Optionally, air filtering member 98 may be removable for cleaning or replaceable.

As exemplified in FIG. 12, clean inlet 36 may be provided in a cover 100 that is removably mounted to turbo brush 10 and, preferably removably mounted to upper surface 14. Cover 100 may be removably mounted by any means known in the art such as that used for cover 82. An advantage of a providing cover 100 that is removable is that the cover may be removed so as to permit an air filtering member 98 associated with clean air inlet 36 to be cleaned or replaced.

Storage Area

In view of the use of clean air turbine 40, only a portion of the air flow generated by the suction fan of the surface cleaning apparatus will travel through primary air flow path 28. Accordingly, the airflow may be insufficient to entrain some of the particulate matter that enters dirty air inlet 22. For example, brush 24 may drive some dirt particles that are to heavy to be entrained in the primary airflow stream into primary airflow path 24. Accordingly, a storage area 104 may be provided to store, or at least temporarily store, particulate material.

Figure 9:
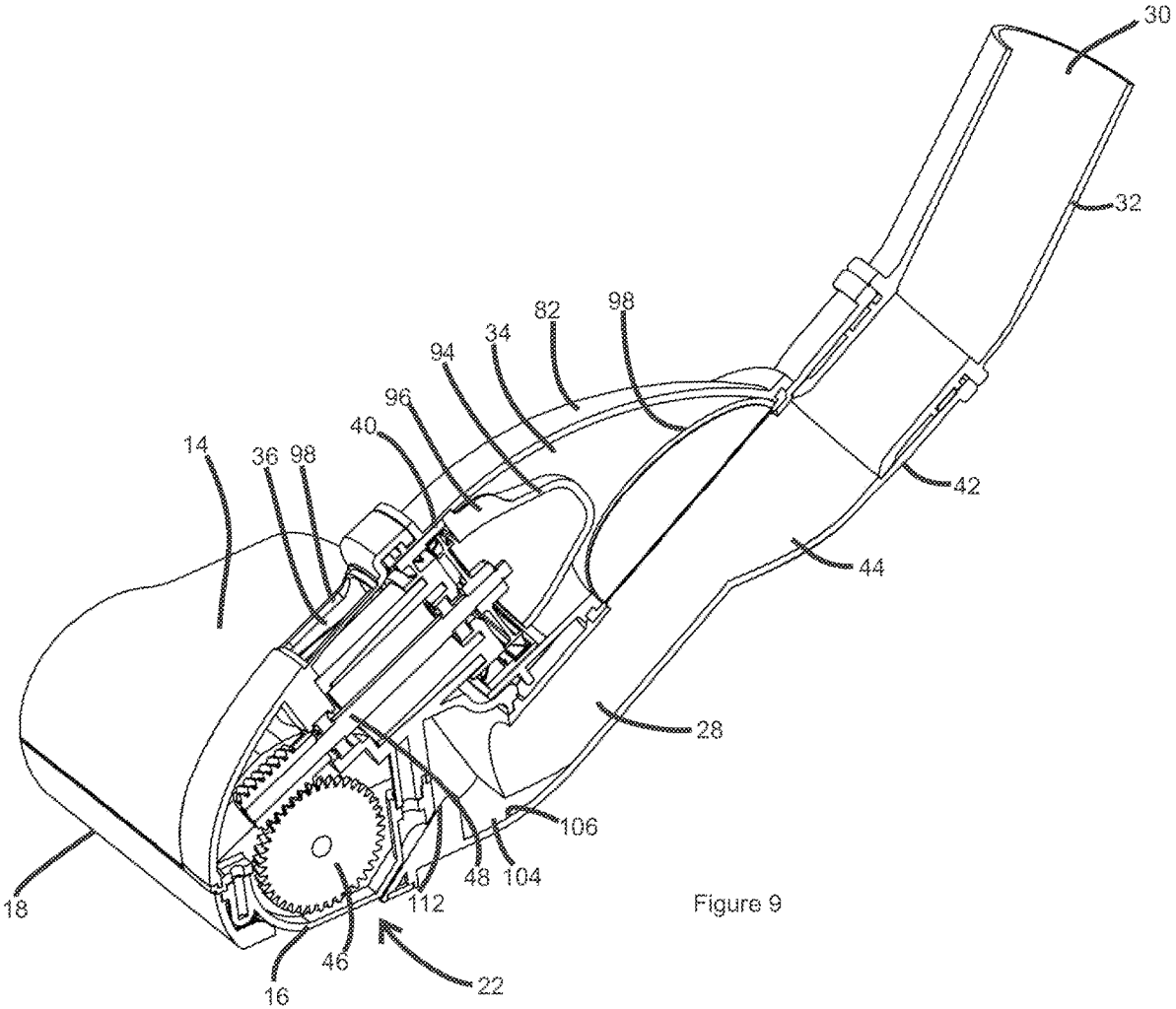
FIG. 9 is a perspective view taken along the cross-sectional line 8-8 of FIG. 1.
Figure 10:
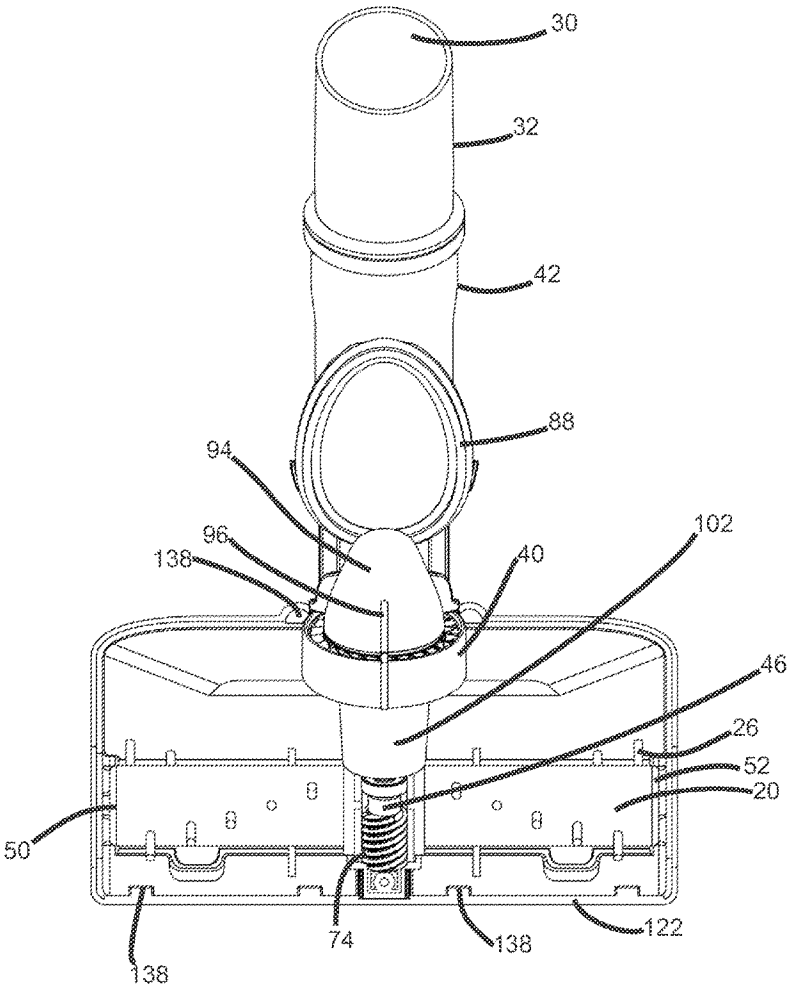
FIG. 10 is a top plan view with the upper clam shell portion removed of the turbo brush of FIG. 1.

As exemplified in FIGS. 8 and 9, storage area 104 is downstream of dirty air inlet 22 and has a recessed lower surface 106. Recessed surface 106 has an upstream end 108 positioned and the downstream end 110. Upstream end 108 is positioned below a lower portion of lower surface 16, which is immediately upstream of upstream end 108. Lower surface 16 may be provided in the form of a ramp 112 that is positioned rearward of brush 24. Accordingly, brush 24 may sweep particulate material up ramp 112 where it may be deposited in the storage area 104. Accordingly, once particulate material reaches storage area 104, the particulate material cannot fall backwards to dirty air inlet 22 and fall out of turbo brush 10 while turbo brush 10 is held in a generally horizontal floor cleaning position. As turbo brush 10 is utilized, some of the particulate material may be entrained in the air travelling through primary air flow path 28. Accordingly, upstream end of lower recess surface 106 preferably merges and has a smooth transition to primary air flow path 28.

It will be appreciated that instead of shaping lower surface 16 so as to provide ramp 112, ramp 112 may be a separate member formed in the interior of housing 12.

In a further preferred embodiment, housing 12 is openable so as to enable storage area 104 to be emptied.

Positioning of the Depressurization Zone

As exemplified in FIG. 11, turbine blades 66 extend between inner vane support 114 and outer vane support 116. Accordingly, the space between inner and outer vane supports 114, 116 comprises an annular air flow passage. Downstream of vane supports 114,116, the cross-sectional area of secondary air flow path 34 increases. As the cross-sectional area for air flow increases, the pressure in the air flow path is reduced. Depressurization occurs when the cross section area increases. This depressurization will occur not just at the position at which the cross-sectional area increases, but upstream thereof. This depressurization occur in a depressurization zone.

In accordance with another preferred embodiment, a cowling 94 may be provided on the downstream side of turbine 40 and may be positioned such that the depressurization zone is located downstream of turbine blades 66. Accordingly, cowling 94, which is preferably mounted so as to be stationary with respect to the turbine, may be provided on the downstream side of turbine 40 and may be configured to provide an annular flow region 118 immediately downstream of turbine 40 that has a cross-sectional area that is, e.g., essentially the same as the cross-sectional area of the air flow path through turbine blades 46. Accordingly, depressurization will not occur immediately after the air exits the turbine blades 66. Instead, the depressurization will occur downstream thereof where the cross-sectional area of cowling 94 is reduced and/or the diameter of path 34 increases. Accordingly, the depressurization zone may be moved downstream from turbine 40 and, preferably, is moved sufficiently downstream thereof such that all of the depressurization zone is downstream of turbine 40

An advantage of this design is that pressure will not be reduced as the air passes through turbine 40, thereby maximizing the possible transfer of energy from the air passing through turbine blades 66 to the turbine blades 66. Accordingly, the efficiency of the turbine may be increased. Preferably, as exemplified cowling 94 is centrally positioned with respect to turbine 40 and may be centrally located in the air flow path downstream of turbine 40

Figure 15:
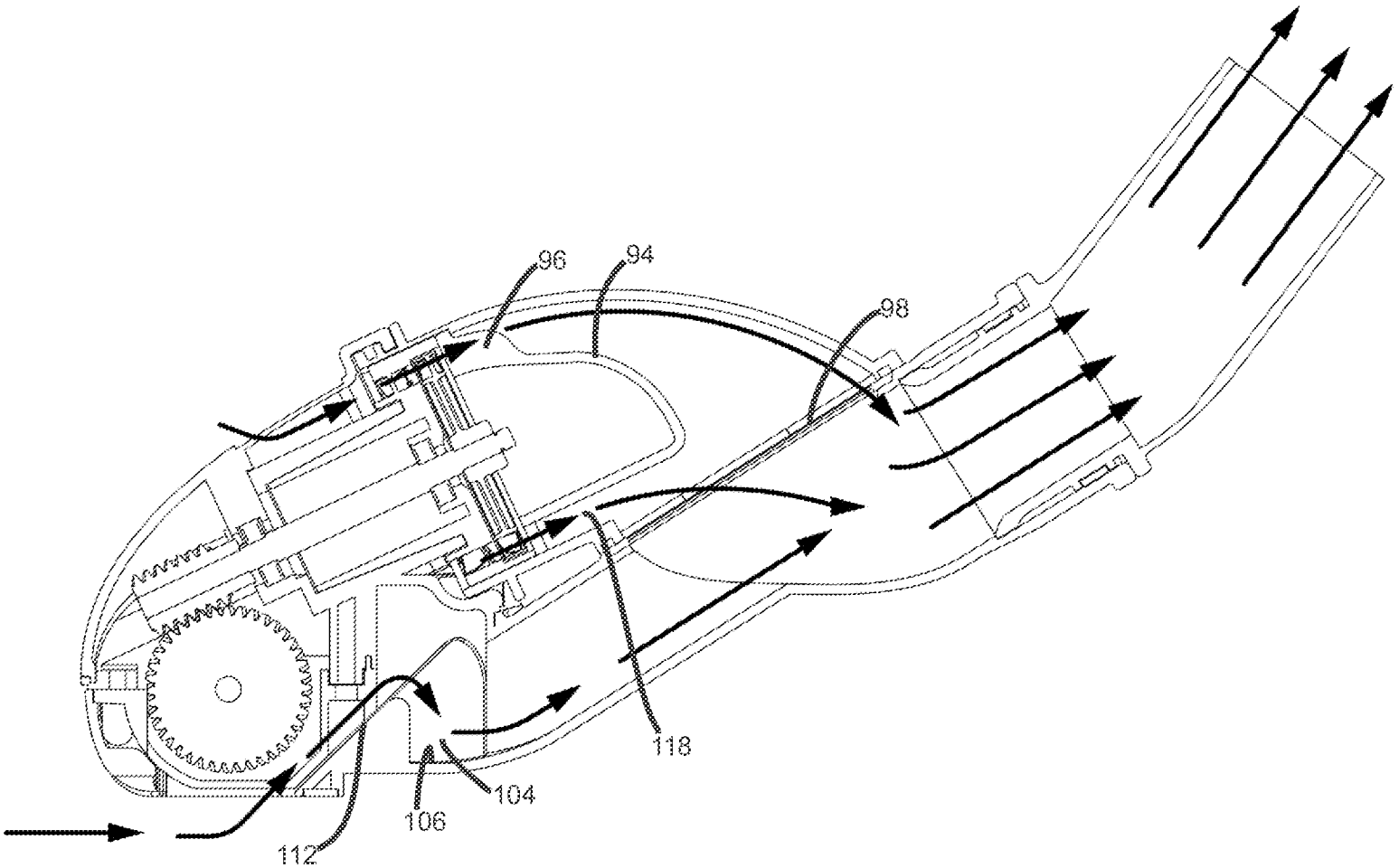
FIG. 15 is a cross-section along the line 8-8 of FIG. 1 of an alternate turbo brush in accordance with this disclosure; and, FIG. 16 is a cross-section along the line 8-8 of a further alternate turbo brush in accordance with another aspect of this invention.

Preferably, cowling 94 has a gradual reduction in a cross-sectional area. For example, it may be bullet nosed. In addition, cowling 94 may be symmetrically shaped. In alternate embodiments, it will appreciated that cowling 94 may be asymmetrically shaped (see for example FIG. 15).

It will be appreciated that, in order to adjust the position of the depressurization zone, cowling 94 need not be provided with vanes 96 as exemplified. However, in a further preferred embodiment, cowling 94 is also provided with vanes 96.

Position of the Clean Air Outlet

If the pressure in the secondary air flow path 34 is less than the pressure in the primary air flow path 28, then some of the air travelling through primary air flow path 28 may be drawn into secondary air flow path 34. In such a case, dirt from the primary air flow path 28 may be drawn into the secondary air flow path 34. This dirt may contaminate or foul turbine 40 thereby reducing the performance of turbine 40. As discussed herein, one option to prevent dirt entering secondary air flow path 34 is to provide a filter member 98 at the juncture of the primary and secondary air paths 28, 34 or upstream thereof in path 34. In addition, or alternately, the position of a depressurization zone downstream of turbine 40 may be adjusted such that the secondary air flow path 34 joins a primary air flow path 28 downstream of the depressurization zone. Accordingly, the position of the clean air outlet 38 may be adjusted so as to be downstream of the depressurization zone.

The position of the downstream end of the depressurization zone may be adjusted by several methods. For example, the position may be adjusted by adjusting the cross sectional area of path 34 compared to path 28. For example, the primary air flow path at the point where clean air outlet 38 is located may have a particular cross-sectional area. The ratio of the cross-sectional area of the flow path through the turbine blades (the turbine flow path cross-sectional area) to the cross-sectional area of the primary air flow path 18 at clean air outlet 38 may be from 4:1-1:4, more preferably from 4:1-1:1 and most preferably from 2:1-1:2. In additional, cowling 94 may be asymmetrically shaped.

Recycle Air Stream

Figure 16:
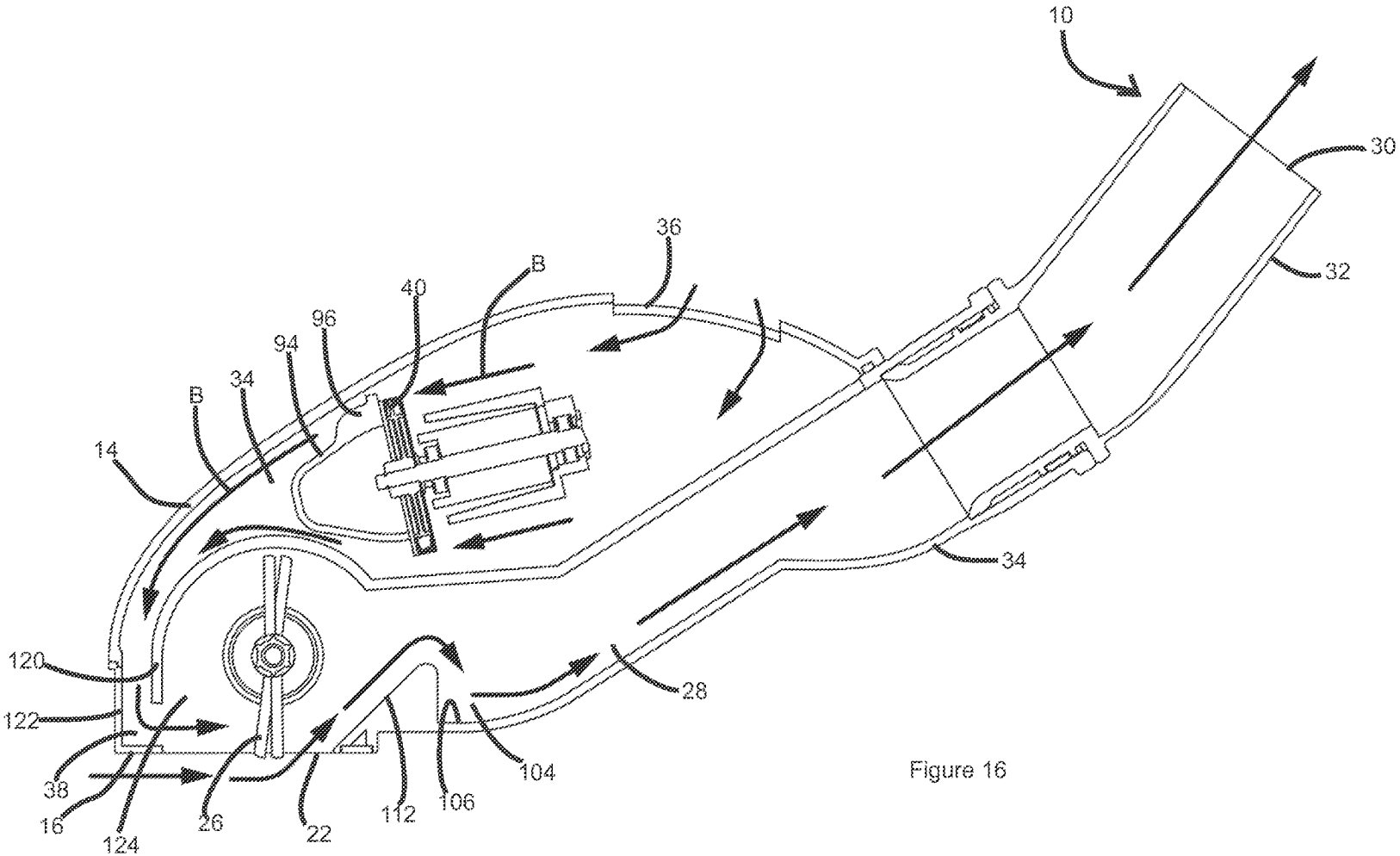

In accordance with another preferred embodiment, outlet 38 of secondary air flow path 34 may be provided at dirty air inlet 22. As exemplified in FIG. 16, secondary air flow stream may enter inlet 36, pass through turbine 40, which may be any turbine known in the art or any turbine disclosed herein, and then travel forwardly in a channel to outlet 38. As exemplified, the channel is provided between upper surface 14 and front wall 122 of housing 12 and upper brush housing 120. The air exits outlet 38 into brush chamber 124. Accordingly, as exemplified, outlet 38 may be provided in upper brush housing 120 and, preferably, is provided between upper brush housing 120 and lower surface 16.

In operation, when the turbo brush 10 is placed on a surface to be cleaned, the dirty air inlet 22 will be partially blocked thereby increasing the back pressure at dirty air inlet 22. This increase in back pressure will result in air being drawn through secondary air flow path 34. Accordingly, the turbine will be activated and therefore brush 24 will commence operation. When turbo brush 10 is raised above the surface to be cleaned, the resistance to flow into dirty air inlet 22 will be reduced. Accordingly, less and, preferably, no air will be drawn through secondary air flow path 34. Accordingly, the turbine will reduce its rate of rotation and, preferably, cease rotation thereby essentially stopping rotary brush 24 when the turbo brush 10 is raised above the surface to be cleaned.

As exemplified, outlet 38 of the secondary air flow path 34 is preferably positioned forward of rotary brush 24. However, in other embodiments, outlet 38 may be rearward of brush 24.

It will be appreciated that outlet 38 is preferably positioned such that air flow through path 34 will be generated only when turbo brush 10 is placed on a surface to be cleaned.

Recessed Channels

As exemplified in the Figures, turbo brush 10 is not provided with any wheels or the like. Accordingly, in use, lower surface 16 will engage the surface to be cleaned. In alternate embodiments, it will be appreciated that wheels, glides or the like may be provided so as to raise lower surface 16 slightly above the surface to be cleaned. However, it is preferred to maintain lower surface 16 proximate to surface to be cleaned (e.g. such that height H may be about 1-10 mm, preferably 2-8 mm and more preferably 3-6 mm). An advantage of this design is that air that is drawn from, e.g., the sides and the front of turbo brush 12 underneath the turbo brush and into the dirty air inlet 22 will have a relatively high velocity.

Due to the proximity of lower surface 16 to the surface being cleaned 126, the cross-section area extending vertically upwardly and transverse to the direction of airflow under housing 12 is relatively small due to the limited height H between the surface being cleaned 126 and lower surface 16. This increases the velocity of the air adjacent to the surface being cleaned 126. However, due to the limited height H between lower surface 16 and the surface to be cleaned 126 (see FIG. 3), larger particulate matter may not be able to pass underneath turbo brush 10. Accordingly, one or more and, preferably, a plurality of raised sections or channels 128 may be provided along the front end 18 and/or the side 130 of housing 12. Accordingly, the air in flow path underneath turbo brush 12 may have portions having an increased height along the length of the lower surface 16. These raised sections or channels provide air flow channels having a larger height thereby permitting larger particles to be drawn through these channels. While the channels provide an increased area for air flow under the turbo brush to dirty air inlet 22, the amount of the cross section area available for air flow is still relatively limited thereby maintaining the velocity of air flow under turbo brush 10 into dirty air inlet 22.

Openable Housing

In accordance with another preferred embodiment, the turbo brush 10 may be openable. For example, it may utilize upper and lower clam shell portions 132, 134 (see for example FIG. 12). Upper and lower claim shell portions 132, 134 may be releasably secured together by any means known in the art. For example, upper and lower clam shell portions may use mating male and female engagement members, which are openable without the use of any tools such as a screw driver. Accordingly, upon physically moving one of the engagement members relative to another engagement member, the clam shell may be opened. An advantage of this design is that access may be provided for, e.g., emptying storage area 104 and/or cleaning a filter member 98, depending upon the placement of the filter member.

As exemplified, locking members are provided at the front and rear of each clam shell portion 132, 134. As exemplified in FIG. 4, lower clam shell portion 134 has a plurality of protrusions or notches 136 provided on front wall 122 and extending rearwardly into the interior of lower clam shell portion 134. In addition, a plurality of recesses 138 are provided on the rear portion of lower clam shell portion 134. In addition, the front of upper clam shell portion 132 is provided with one or more flanges 140 having openings 142 which are sized and positioned for receiving protrusions 136 on lower clam shell portion 134. The rear of upper clam shell portion 132 is provided with posts 144 which are positioned and sized to be received in recesses 138 on lower clam shell portion 134.

Posts 144 are preferably sized so as to be frictionally secured in recesses 138. Accordingly, the upper clam shell portion 132 may be positioned such that protrusions 136 are received in openings 142 of flanges 140. The rear portion of upper clam shell portion 132 may then be rotated downwardly so that posts 144 are received and secured in recesses 138.

In order to assist in providing an air tight seal, one of the clam shell portions may have a groove extending around the perimeter thereof for receiving a mating flange provided on the other clam shell portion. Alternately or in addition, a gasket may be provided along the perimeter of one of the clam shell portions. Alternately, as exemplified, an outer flange 146 which extends upwardly may be provided along the side and rear perimeter of lower clam shell portion 134 and an inner flange 148 may be provided on the side and rear perimeter of the upper clam shell portion 132. When assembled, inner flange 148 is positioned inwardly from and adjacent outer flange 146. Once again, a gasket or the like may be provided between the flanges. Accordingly, a user may open clam shell portions 132, 134 when desired.

In the alternate embodiment, it would be appreciated that the rear portions of clam shell portions 132,134 may be secured together by, e.g. screws or other mechanical fasteners which extend through screw ports provided in the rear of upper clam shell portion 132 and which are received, e.g., in recesses 138. In this case, recesses 138 are preferably provided with an internal threaded screw.

It will be appreciated that a turbo brush may use one or more of the features disclosed herein. Further, it will be appreciated that what has been described above has been intended to be illustrative of the invention and non-limiting and it will be understood by a person skilled in the art that various variants and modifications may be made without departing from the scope of the invention as defined in any of the claims appended hereto.

The invention claimed is:

1. A turbo brush for cleaning a surface comprising:

(a) a housing having an upper surface, a lower surface, a front end and a rear end the lower surface having a dirty air inlet;

(b) a primary air flow path extending from the dirty air inlet to a dirty air outlet;

(c) a rotary brush associated with the dirty air inlet and extending along a brush axis that is generally parallel to the front end, the rotary brush comprising a first end and an opposing second end that is axially spaced from the first end;

(d) a drive worm gear that is provided on the rotary brush between the axially opposed first and second ends; and, (e) a drive mechanism comprising an air driven turbine drivingly connected to a shaft having a worm provided thereon, and the worm directly drivingly engages the drive worm gear wherein the front end is spaced from the rear end in a first direction and the air driven turbine has a turbine axis of rotation that is generally parallel to the first direction and is generally orthogonal to the brush axis.

2. The turbo brush of claim 1 wherein the secondary airflow path joins the primary airflow path upstream of the dirty air outlet.

3. A turbo brush for cleaning a surface comprising:

(a) a housing having an upper surface, a lower surface, a front end and a rear end the lower surface having a dirty air inlet;

(b) a primary air flow path extending from the dirty air inlet to a dirty air outlet;

(c) a rotary brush associated with the dirty air inlet and extending along a brush axis that is generally parallel to the front end, the rotary brush comprising a first end and an opposing second end that is axially spaced from the first end;

(d) a drive worm gear that is provided on the rotary brush between the axially opposed first and second ends; and, (e) a drive mechanism comprising an air driven turbine drivingly connected to a shaft having a worm provided thereon, and the worm directly drivingly engages the drive worm gear;

wherein the air driven turbine is a clean air turbine and the turbo brush further comprises a secondary airflow path including the air driven turbine and extending from a clean air inlet to a position downstream from the air driven turbine; and wherein the secondary airflow path from the clean air inlet to a position downstream of the air driven turbine is generally linear.

4. A turbo brush comprising:

(a) a housing having an upper surface, a lower surface, a front end and a rear end, the lower end having a dirty air inlet;

(b) a primary air flow path extending from the dirty air inlet to a dirty air outlet;

(c) a rotary brush associated with the dirty air inlet and extending along the direction of the front end;

(d) a drive mechanism comprising an air driven turbine, a drive worm gear mounted to the rotary brush and a worm driven by the turbine directly drivingly engages the drive worm gear; and, (e) a cowling downstream of the air driven turbine wherein the cowling includes a plurality of vanes extending in a direction of flow of air immediately downstream of the air driven turbine.

5. The turbo brush of claim 1 wherein the drive worm gear is positioned at an axial midpoint between the opposed first and second ends of the rotary brush.

6. The turbo brush of claim 1 wherein the rotary brush is provided with a plurality of bristles, wherein the bristles extend at an angle relative to the brush axis so as to axially overlie the drive mechanism.

7. The turbo brush of claim 1 wherein the rotary brush comprises a plurality of bristles and the bristles extend at an angle relative to the brush axis so as to brush a portion of the surface that is axially directly beneath the worm.

8. The turbo brush of claim 1 further comprising an air filtering member positioned upstream of the air driven turbine.

9. The turbo brush of claim 2 further comprising an air filtering member positioned between a downstream side of the air driven turbine and the primary air flow path.

10. A turbo brush for cleaning a surface comprising:

(a) a housing having an upper surface, a lower surface, a front end and a rear end the lower surface having a dirty air inlet;

(b) a primary air flow path extending from the dirty air inlet to a dirty air outlet;

(c) a rotary brush associated with the dirty air inlet and extending along a brush axis that is generally parallel to the front end, the rotary brush comprising a first end and an opposing second end that is axially spaced from the first end;

(d) a drive worm gear that is provided on the rotary brush between the axially opposed first and second ends; and, (e) a drive mechanism comprising an air driven turbine drivingly connected to a shaft having a worm provided thereon, and the worm directly drivingly engages the drive worm gear wherein the air driven turbine is a clean air turbine and the turbo brush further comprises a secondary airflow path including the air driven turbine and extending from a clean air inlet to a position downstream from the air driven turbine wherein the primary airflow path has a lower surface, and the primary airflow path includes a storage area having a recessed lower surface, the storage area being positioned downstream from the brush chamber and upstream from a position where the secondary airflow path joins the primary air flow path wherein the recessed lower surface has an upstream end and a downstream end, the upstream end positioned below a portion of the lower surface that is immediately upstream of the upstream end of the recessed lower surface.

11. A turbo brush for cleaning a surface comprising:

(a) a housing having an upper surface, a lower surface, a front end and a rear end the lower surface having a dirty air inlet;

(b) a primary air flow path extending from the dirty air inlet to a dirty air outlet;

(c) a rotary brush associated with the dirty air inlet and extending along a brush axis that is generally parallel to the front end, the rotary brush comprising a first end and an opposing second end that is axially spaced from the first end;

(d) a drive worm gear that is provided on the rotary brush between the axially opposed first and second ends; and, (e) a drive mechanism comprising an air driven turbine drivingly connected to a shaft having a worm provided thereon, and the worm directly drivingly engages the drive worm gear wherein the air driven turbine has turbine blades and an associated depressurization zone downstream thereof and the turbo brush further comprises a cowling downstream of the air driven turbine and positioned such that the depressurization zone is located downstream of the turbine blades.

12. The turbo brush of claim 11 wherein the primary air flow path includes an airflow path downstream of the air driven turbine, the airflow path downstream of the air driven turbine having a cross sectional area greater than a cross sectional area of a flow path through the blades of the air driven turbine.

13. The turbo brush of claim 11 wherein the cowling is generally centrally located in the airflow path downstream of the air driven turbine and has a cross sectional area that decreases in a downstream direction.

14. The turbo brush of claim 1 wherein, when the turbo brush is positioned on a flat surface, an air inflow path is defined between the flat surface and the lower surface forward of the rotary brush, the lower surface forward of the rotary brush extends transversely to a forward direction of motion and has raised sections along a length of the lower surface forward of the rotary brush such that the air inflow path has portions having an increased height along the length of the lower surface.

15. The turbo brush of claim 1 wherein the lower surface forward of the rotary brush has a plurality of rearwardly extending raised sections.

16. The turbo brush of claim 1 wherein the housing comprises upper and lower clam shell portions that are openable.

17. The turbo brush of claim 16 wherein the primary airflow path has a lower surface, and the primary airflow path includes a storage area having a recessed lower surface whereby, when the clam shell portions are opened, the storage area is accessible.

18. The turbo brush of claim 2 further comprising an air filtering member positioned between a downstream side of the air driven turbine and the primary air flow path and the housing comprises upper and lower clam shell portions that are openable, whereby, when the clam shell portions are opened, the air filtering member is accessible.

19. The turbo brush of claim 1 wherein the air driven turbine is located above the primary air flow path whereby air entering the turbo brush travels rearwardly below the air driven turbine from the brush chamber to the position at which the primary and secondary air flow paths meet.

* * * * *